US008269831B2

(12) United States Patent
Kim et al.

(10) Patent No.: US 8,269,831 B2
(45) Date of Patent: Sep. 18, 2012

(54) WIRE GUIDER OF AIR GUIDE TYPE

(75) Inventors: Won-Bong Kim, Kyungsangbook-do (KR); Ki-Taek Seong, Kyungsangbook-do (KR); Yeong-Bem Shin, Kyungsangbook-do (KR); Dal-Ki Min, Kyungsangbook-do (KR); Chul Yoon, Kyungsangbook-do (KR)

(73) Assignee: POSCO, Pohang (KR)

( * ) Notice: Subject to any disclaimer, the term of this patent is extended or adjusted under 35 U.S.C. 154(b) by 1078 days.

(21) Appl. No.: 12/094,680

(22) PCT Filed: Nov. 29, 2006

(86) PCT No.: PCT/KR2006/005108

§ 371 (c)(1), (2), (4) Date: Aug. 6, 2008

(87) PCT Pub. No.: WO2007/064153

PCT Pub. Date: Jun. 7, 2007

(65) Prior Publication Data

US 2008/0296336 A1 Dec. 4, 2008

(30) Foreign Application Priority Data

Nov. 29, 2005 (KR) ..... 10-2005-0114883
Nov. 29, 2005 (KR) ..... 10-2005-0114884
Nov. 29, 2005 (KR) ..... 10-2005-0114885

(51) Int. Cl.
*H04N 7/18* (2006.01)

(52) U.S. Cl. ..... 348/88; 348/125

(58) Field of Classification Search ..... 348/88, 348/94, 125, 128

See application file for complete search history.

(56) References Cited

U.S. PATENT DOCUMENTS

| | | | | |
|---|---|---|---|---|
| 5,107,214 | A | 4/1992 | Yoshida et al. | |
| 5,404,634 | A * | 4/1995 | Takeshita et al. | 29/564.4 |
| 6,023,837 | A * | 2/2000 | Finn | 29/566.1 |
| 7,307,729 | B2 * | 12/2007 | Moshe | 356/430 |
| 2003/0010813 | A1 * | 1/2003 | Nakaya | 228/245 |
| 2006/0033919 | A1 * | 2/2006 | Moshe | 356/430 |
| 2006/0230803 | A1 * | 10/2006 | Ruzovic et al. | 72/138 |

FOREIGN PATENT DOCUMENTS

| | | | |
|---|---|---|---|
| DE | 19909170 | A1 | 9/2000 |
| JP | 59030309 | U | 2/1984 |
| JP | 1150676 | A | 6/1989 |
| JP | 1177929 | A | 7/1989 |
| JP | 2126153 | A | 5/1990 |
| JP | 2236158 | A | 9/1990 |
| JP | 4266442 | A | 9/1992 |
| JP | 5097325 | A | 4/1993 |
| JP | 5051864 | U | 7/1994 |
| JP | 2006258737 | A | 9/2006 |
| KR | 20010064341 | A | 7/2001 |

* cited by examiner

*Primary Examiner* — Patrice Winder
(74) *Attorney, Agent, or Firm* — The Webb Law Firm

(57) ABSTRACT

A wire guider includes a guiding unit having an inner path extending along the running direction of the wire to guide the running of the wire and an air supply unit for supplying air into the inner path to form a spiral air flow having a current rate faster than a running rate of the wire between an outer surface of the wire and an inner surface of the inner path. Wire Vibration resulting from a thrust force of mill rolls can be damped to more stably carry out one-direction running of the wire and minimize contact between the wire and a guide path. This reduces surface defects of the wire and abrasion of the guide system and protects a sensor unit from damage.

62 Claims, 27 Drawing Sheets

[Fig. 1]
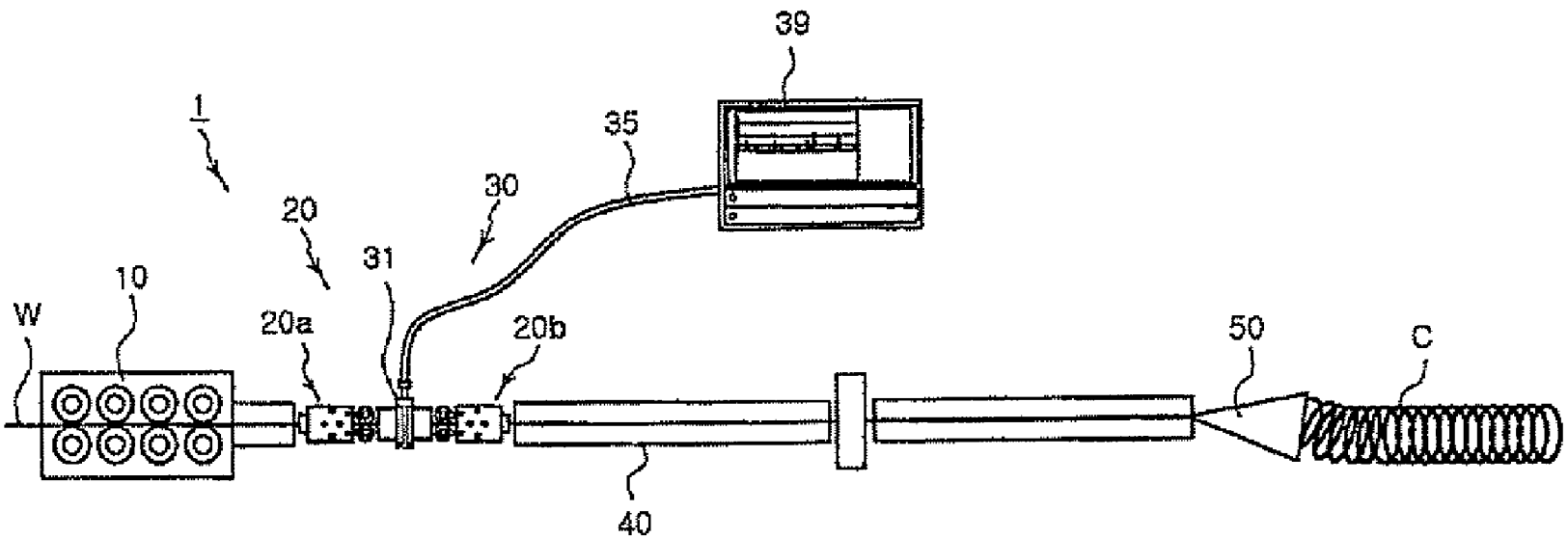
Prior Art

[Fig. 2]
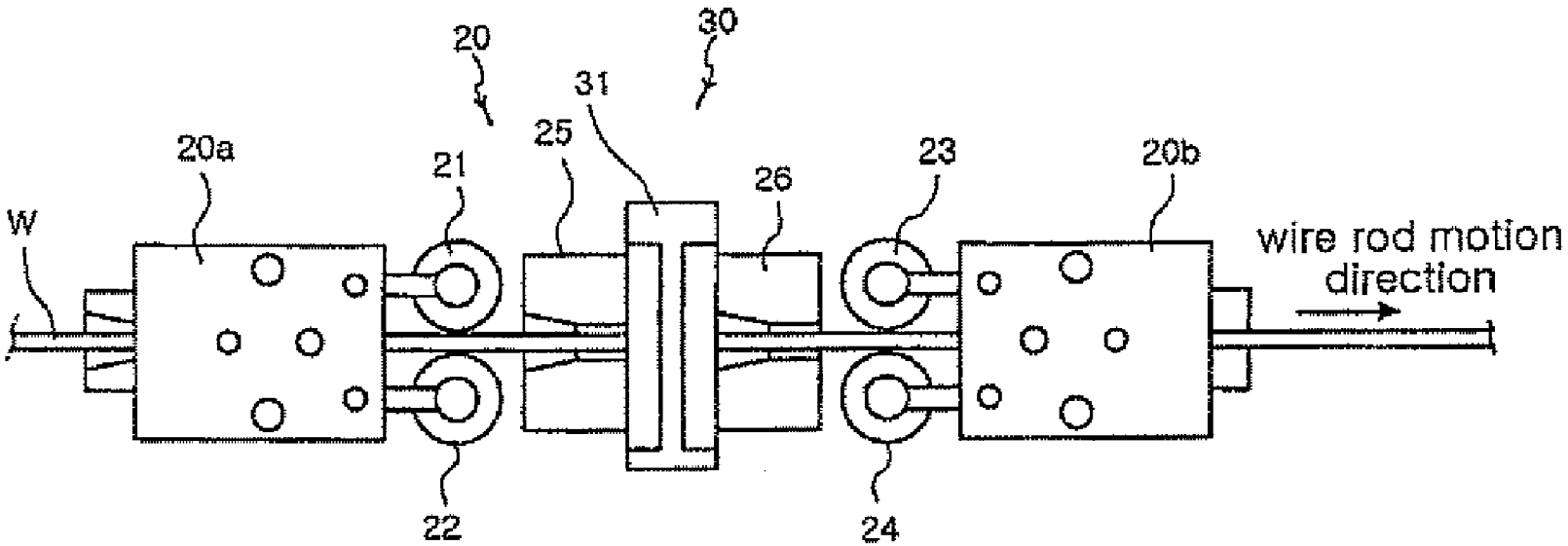
Prior Art

[Fig. 3]
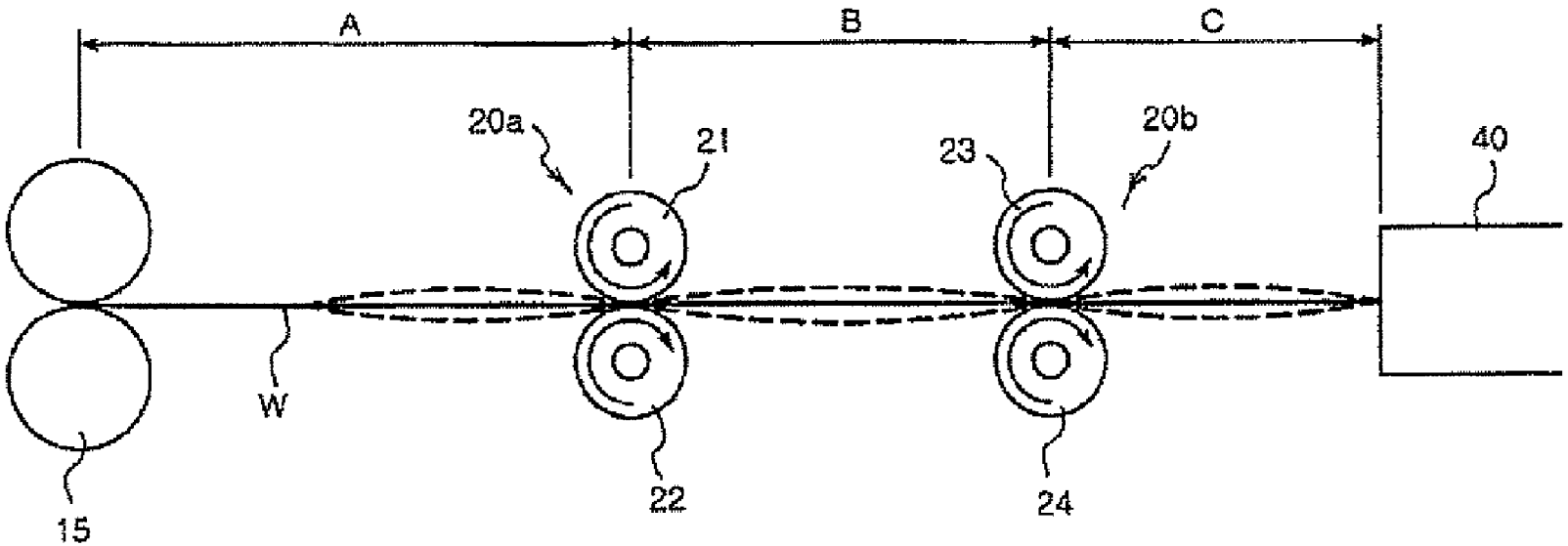
Prior Art

[Fig. 4]
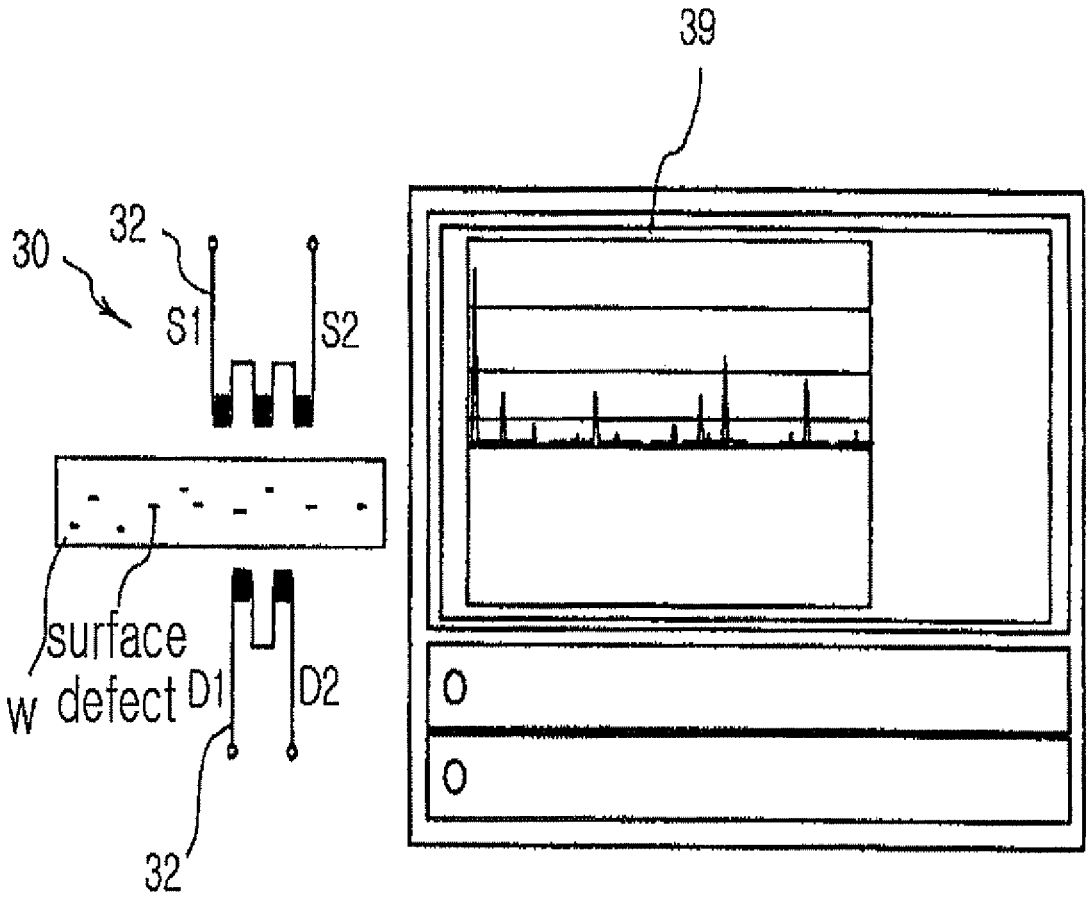
Prior Art

[Fig. 5]
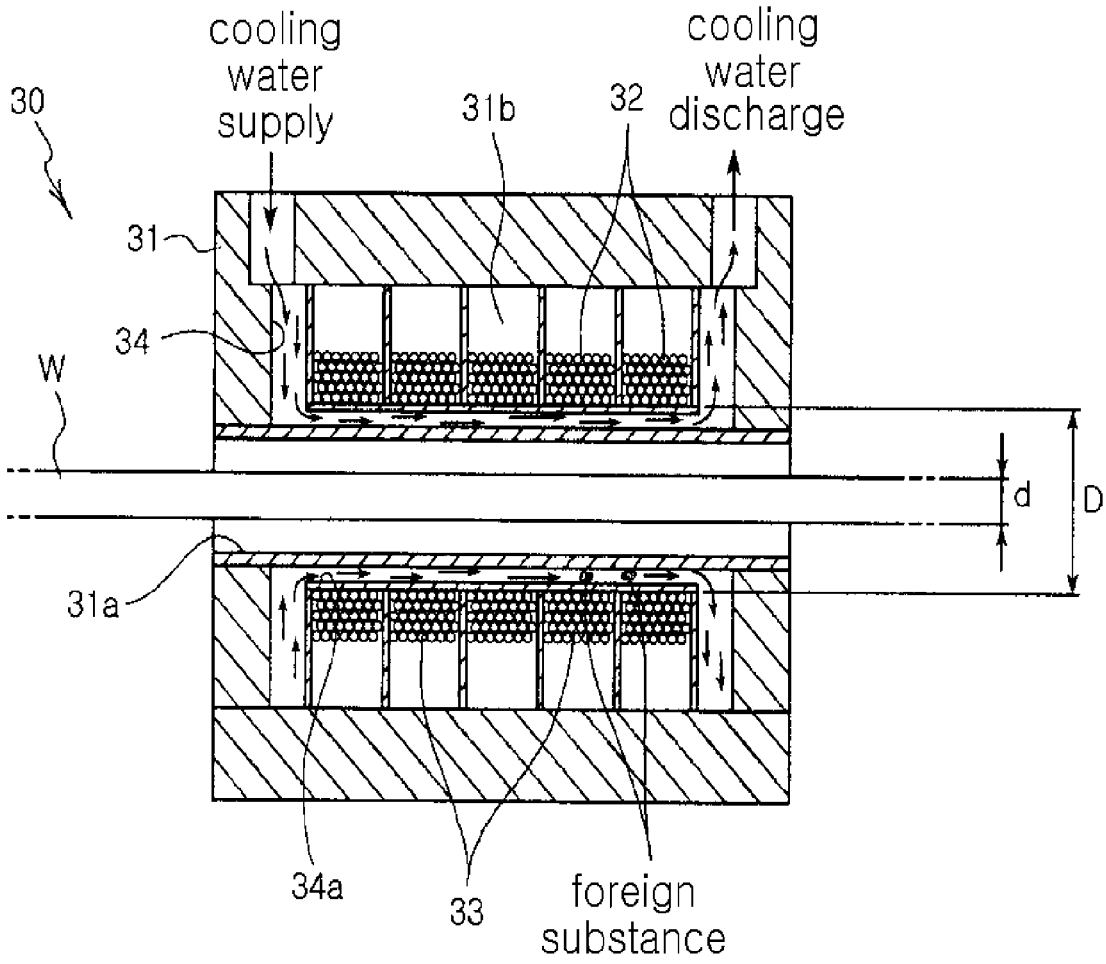

[Fig. 6]
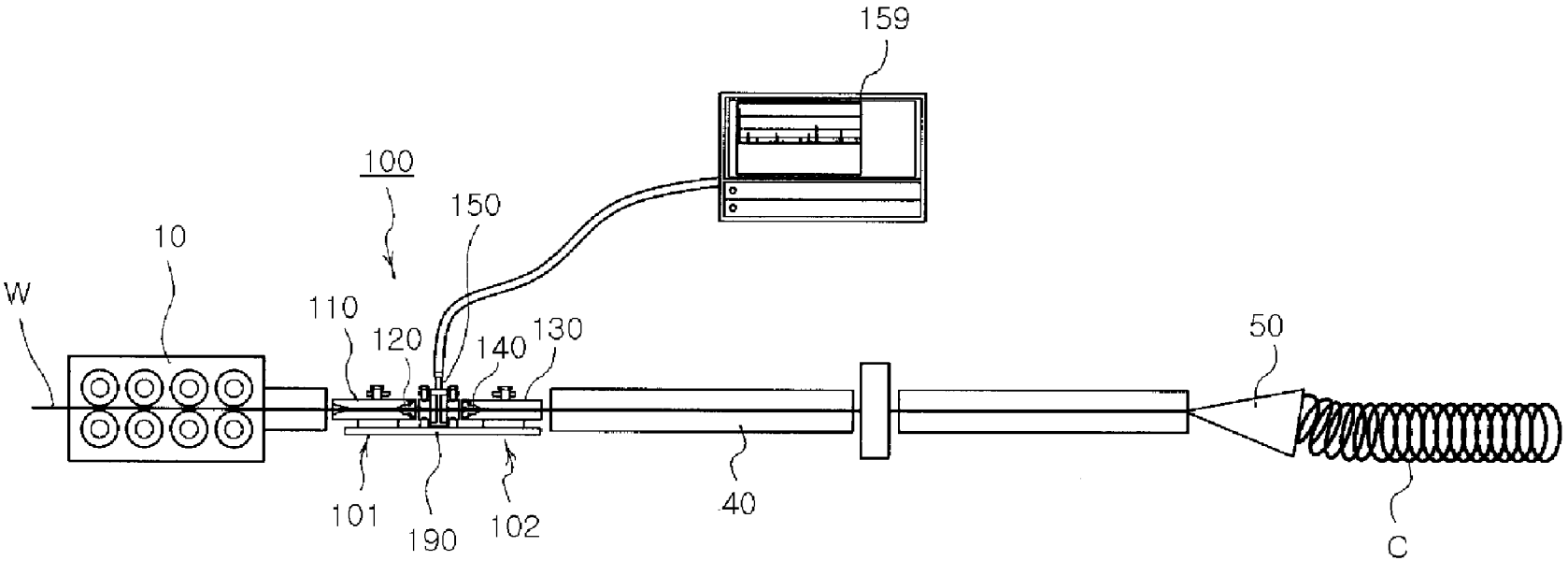

[Fig. 7]
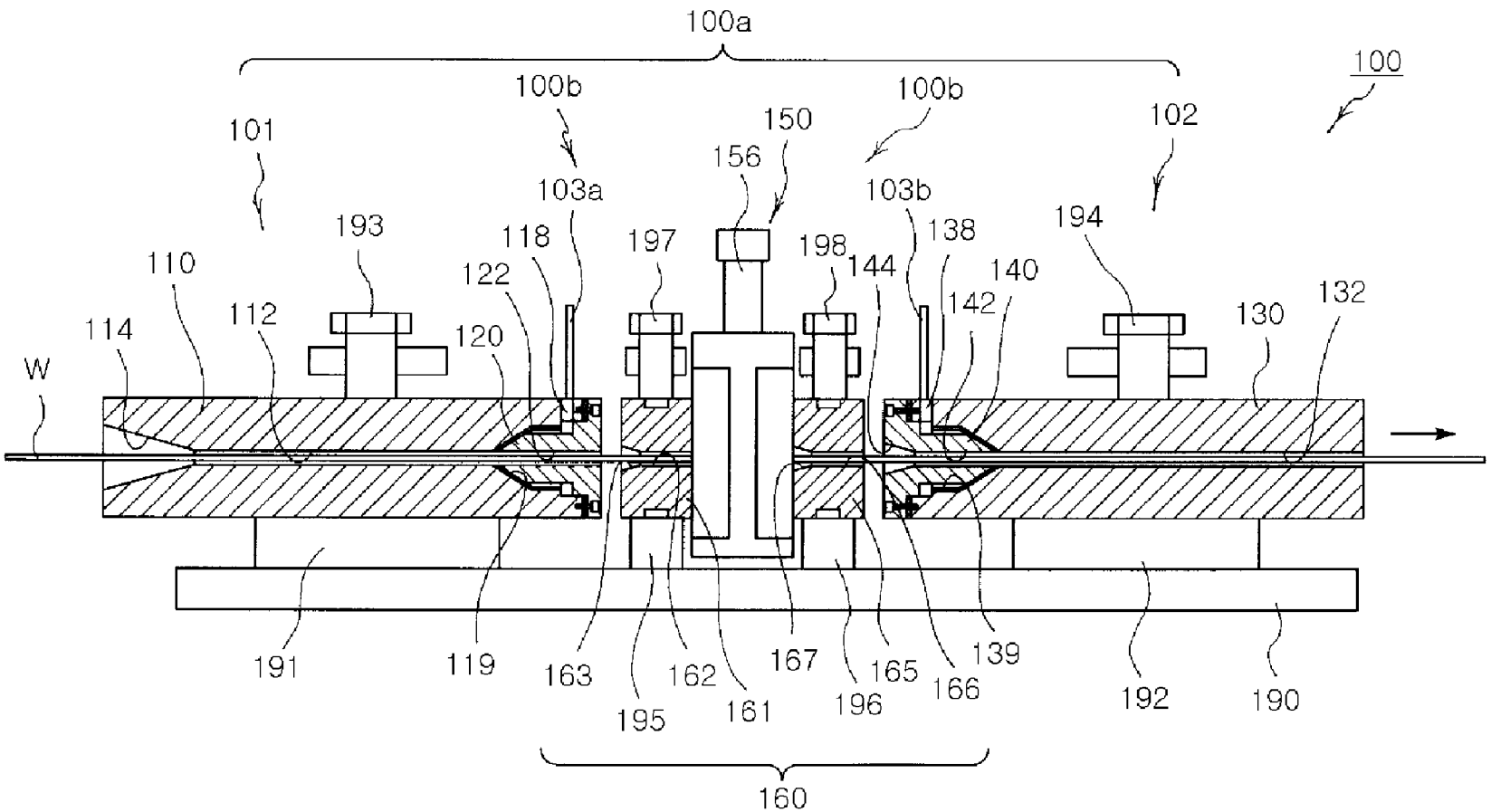

[Fig. 8]
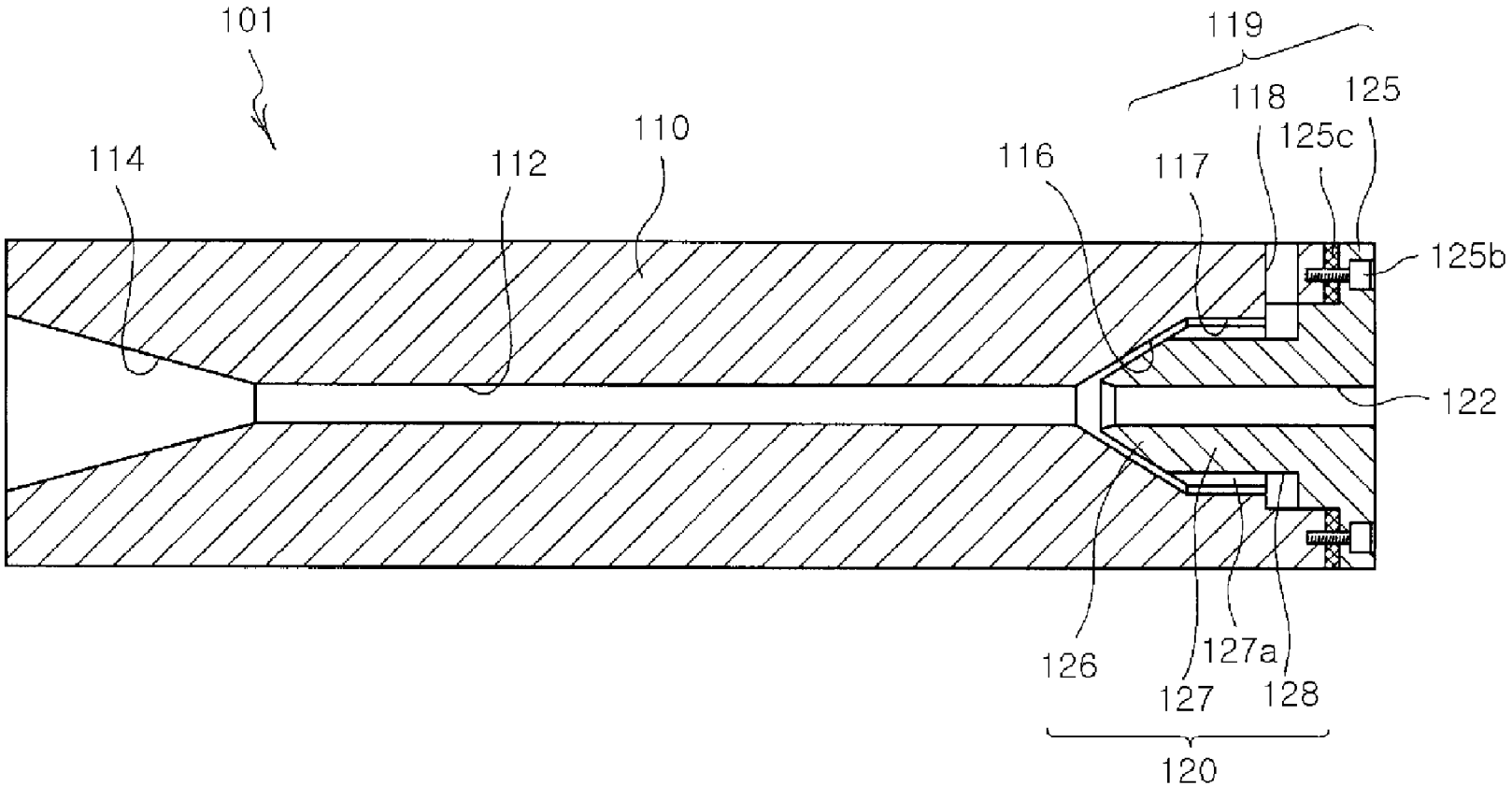

[Fig. 9]
(a)
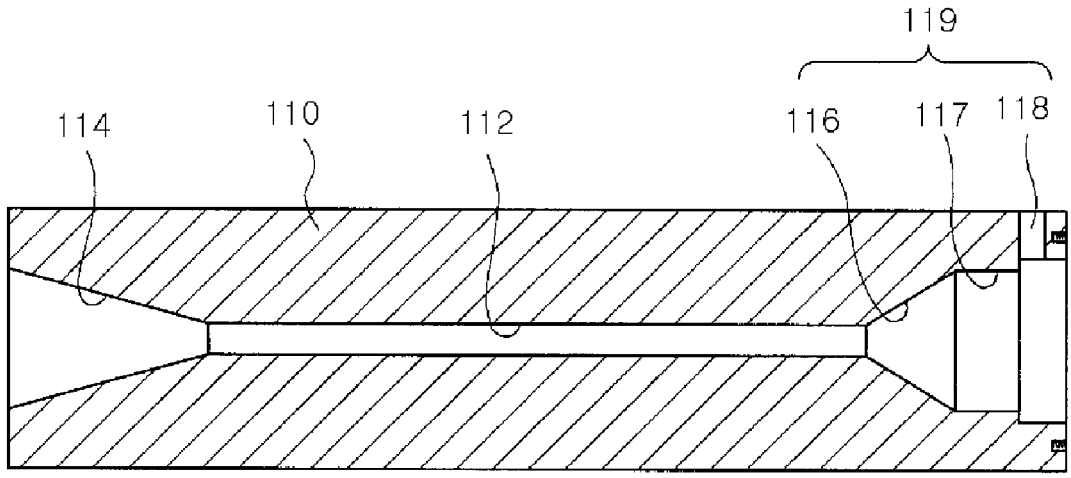
(b)
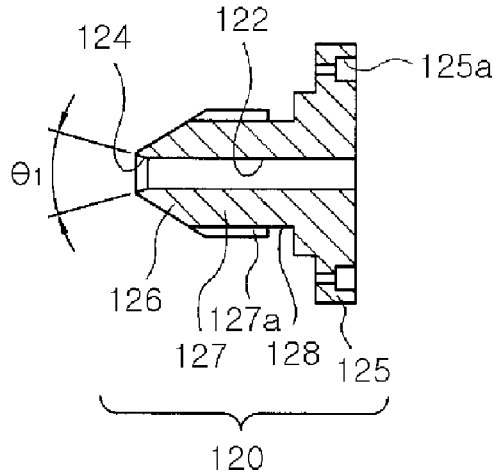
(c)
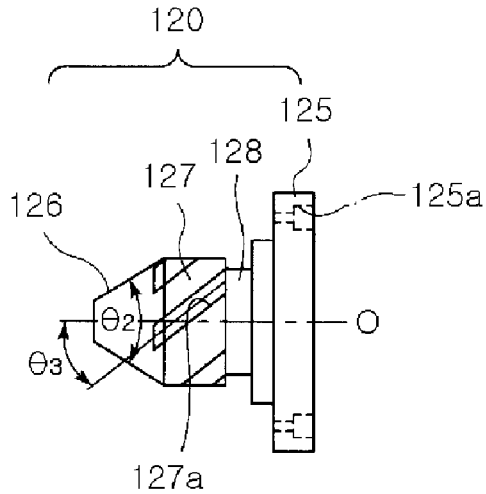

[Fig. 10]
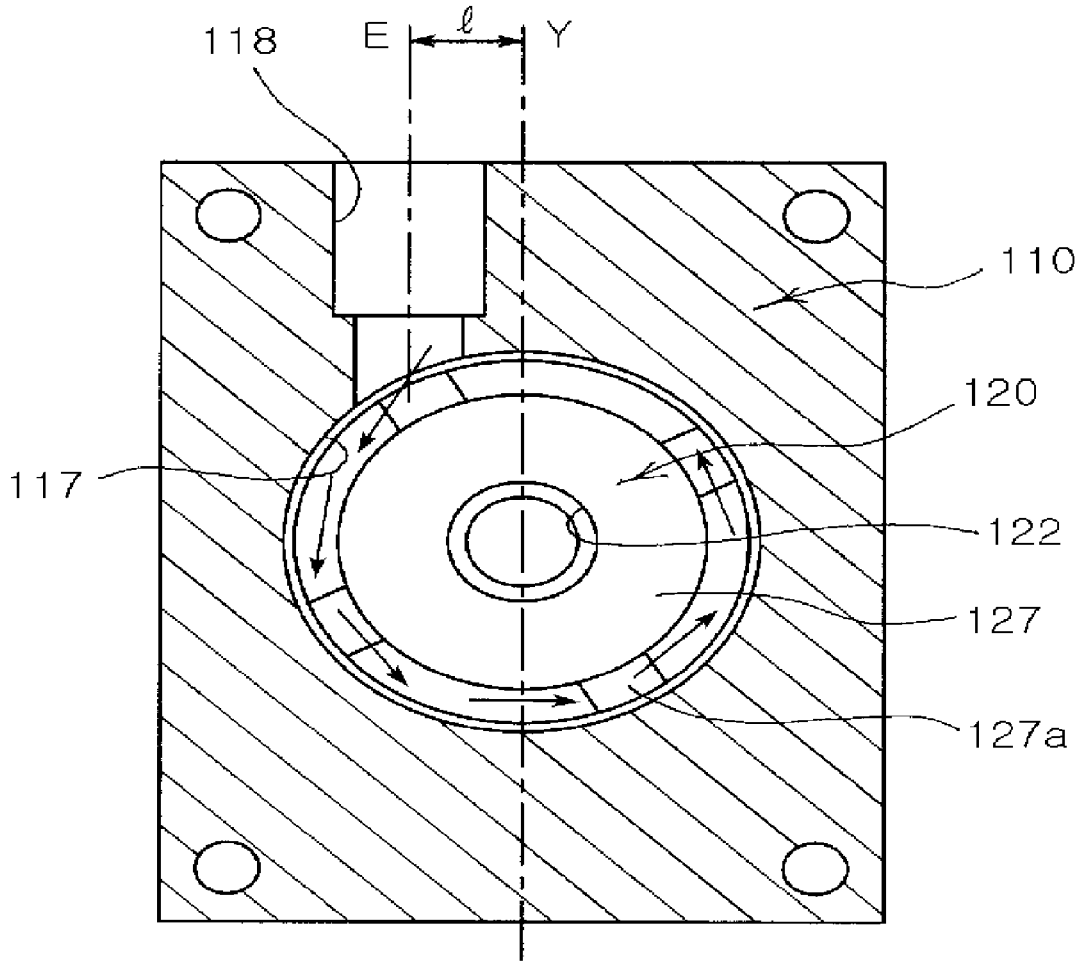

[Fig. 11]
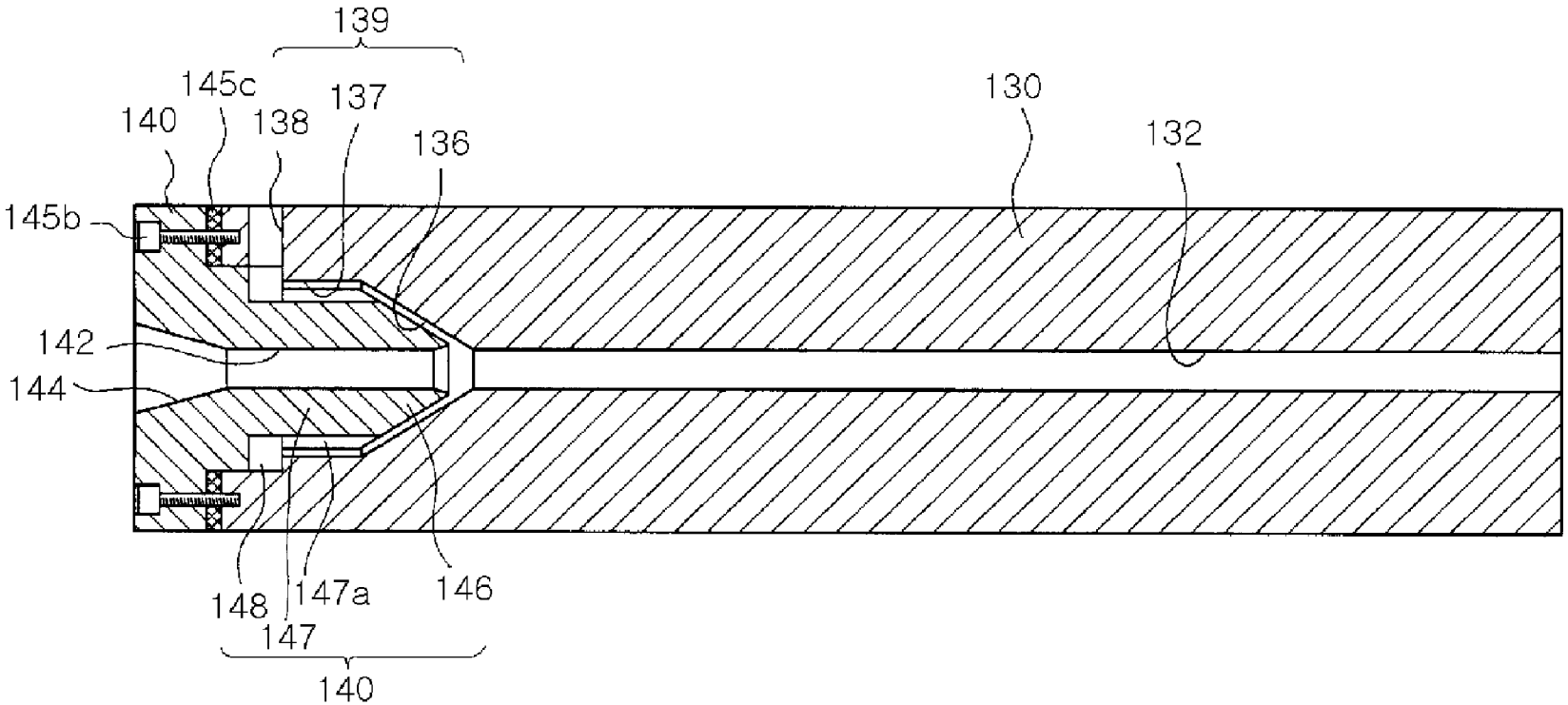

[Fig. 12]
(a)
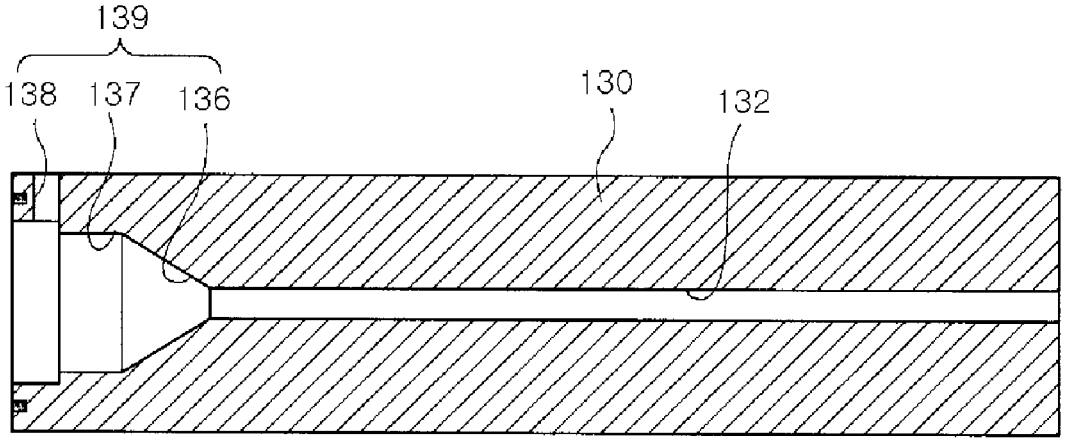
(b)
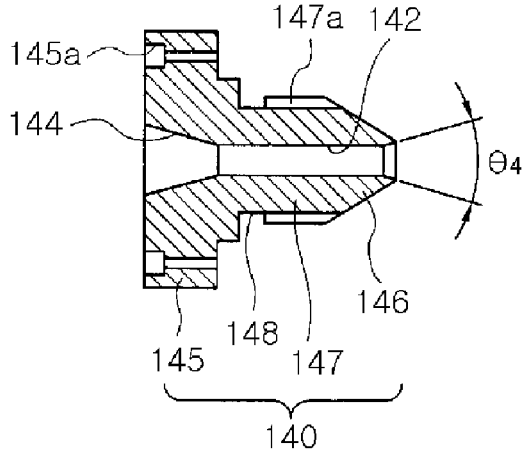
(c)
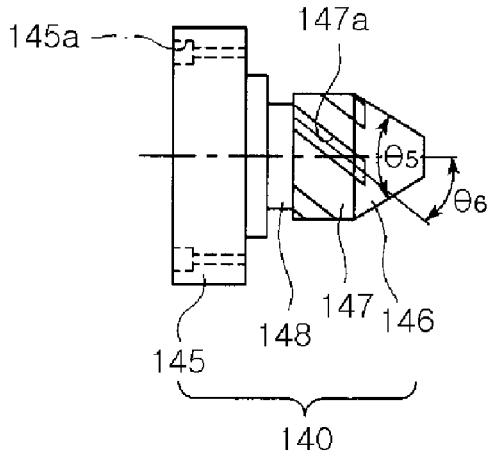

[Fig. 13]
(a)
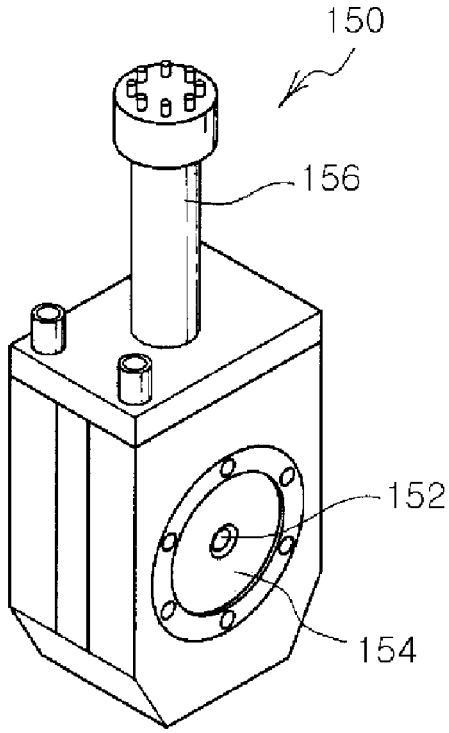
(b)
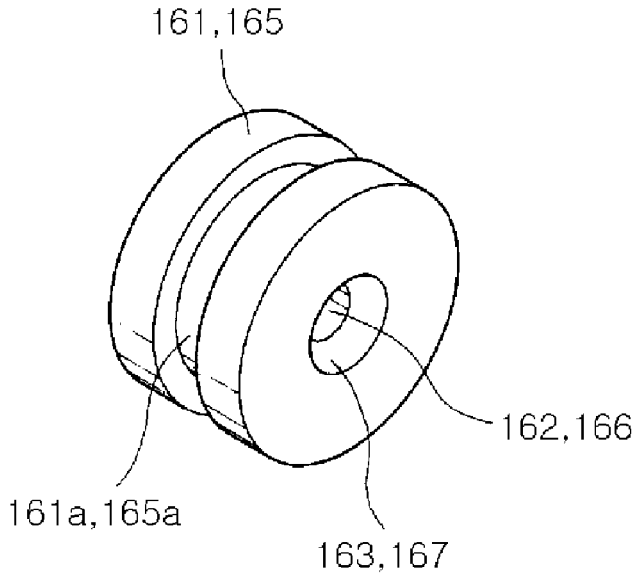

[Fig. 14]
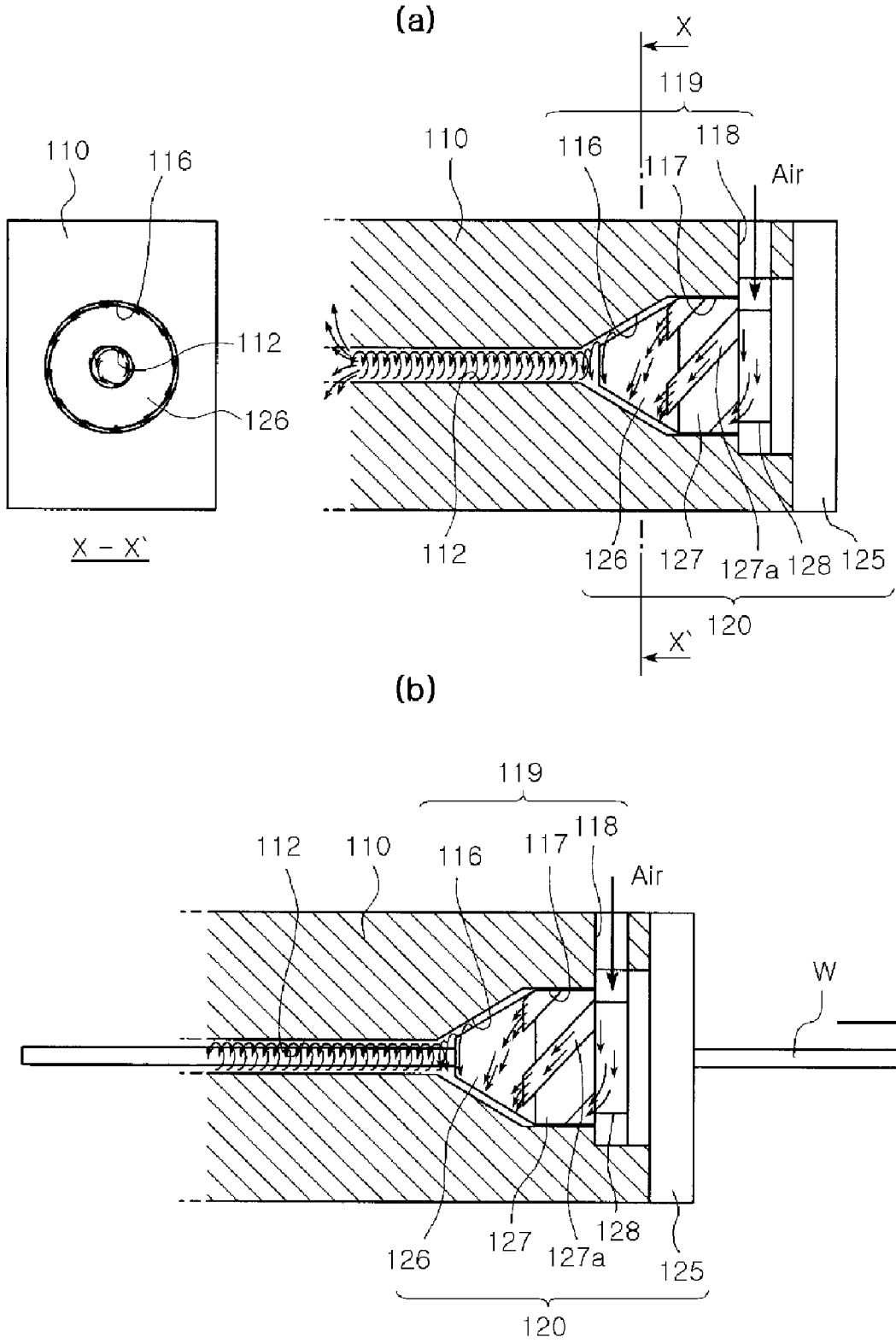

[Fig. 15]
(a)
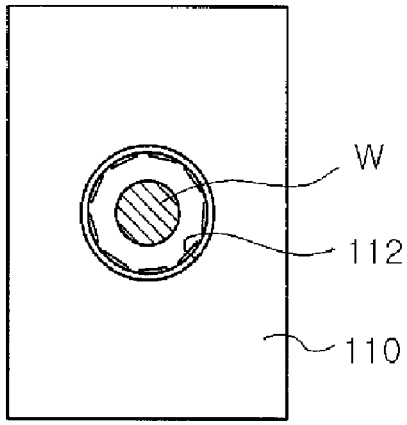
(b)
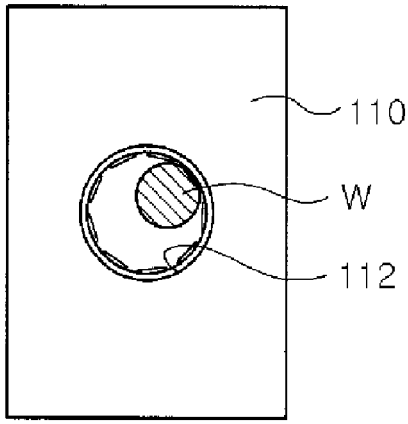
(c)
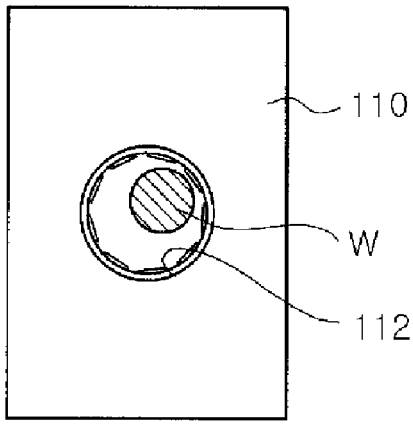

[Fig. 16]
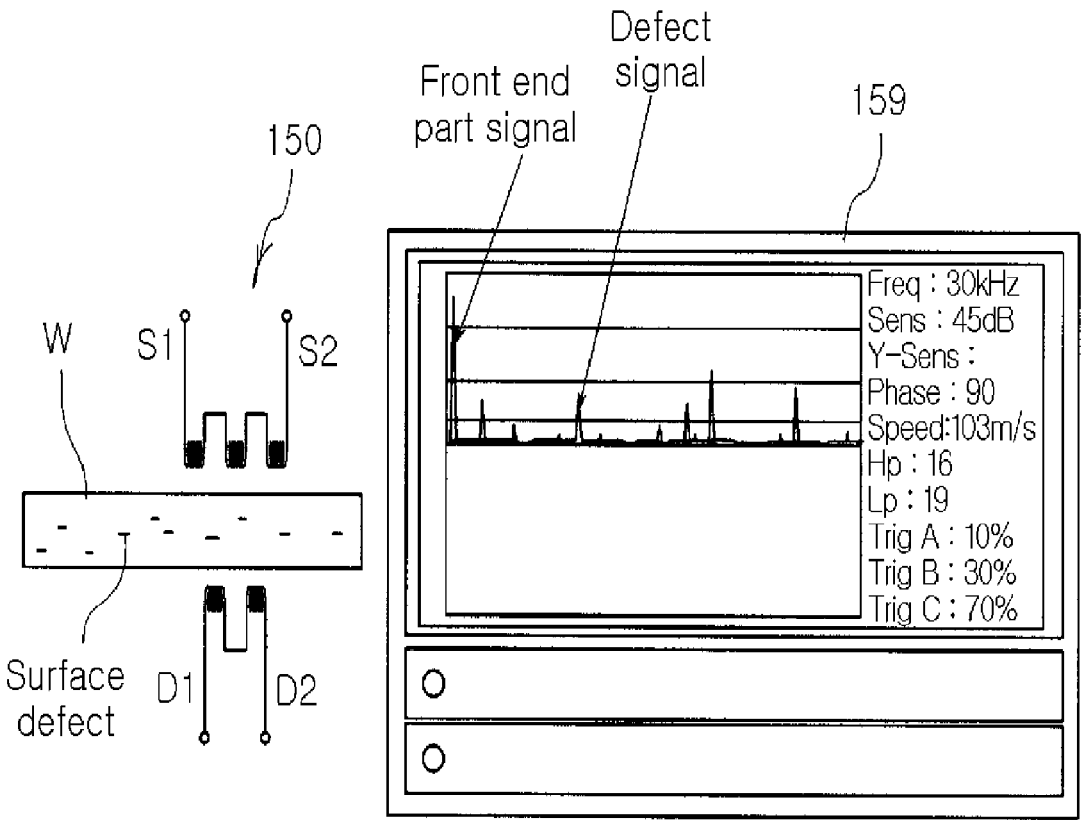

[Fig. 17]
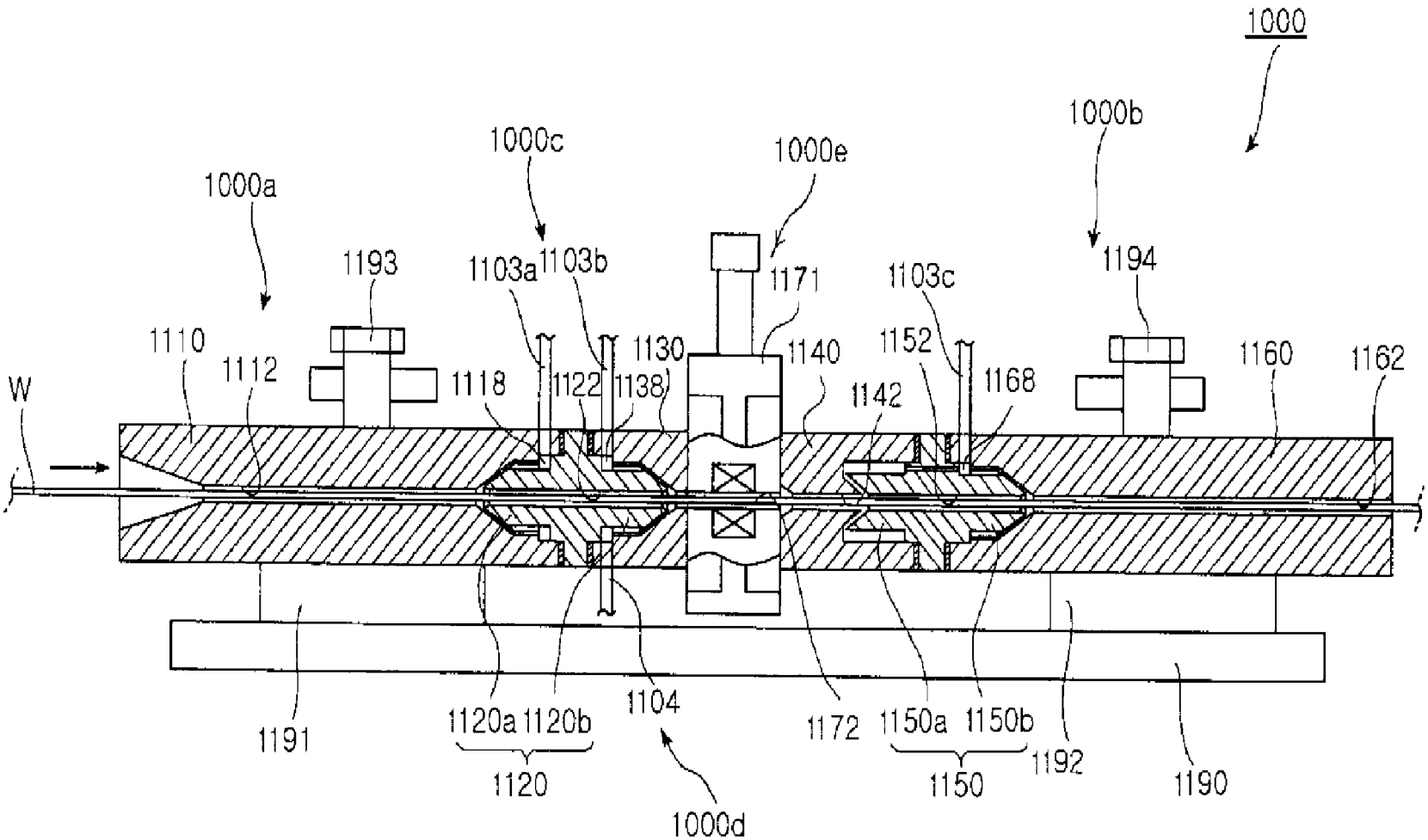

[Fig. 18]
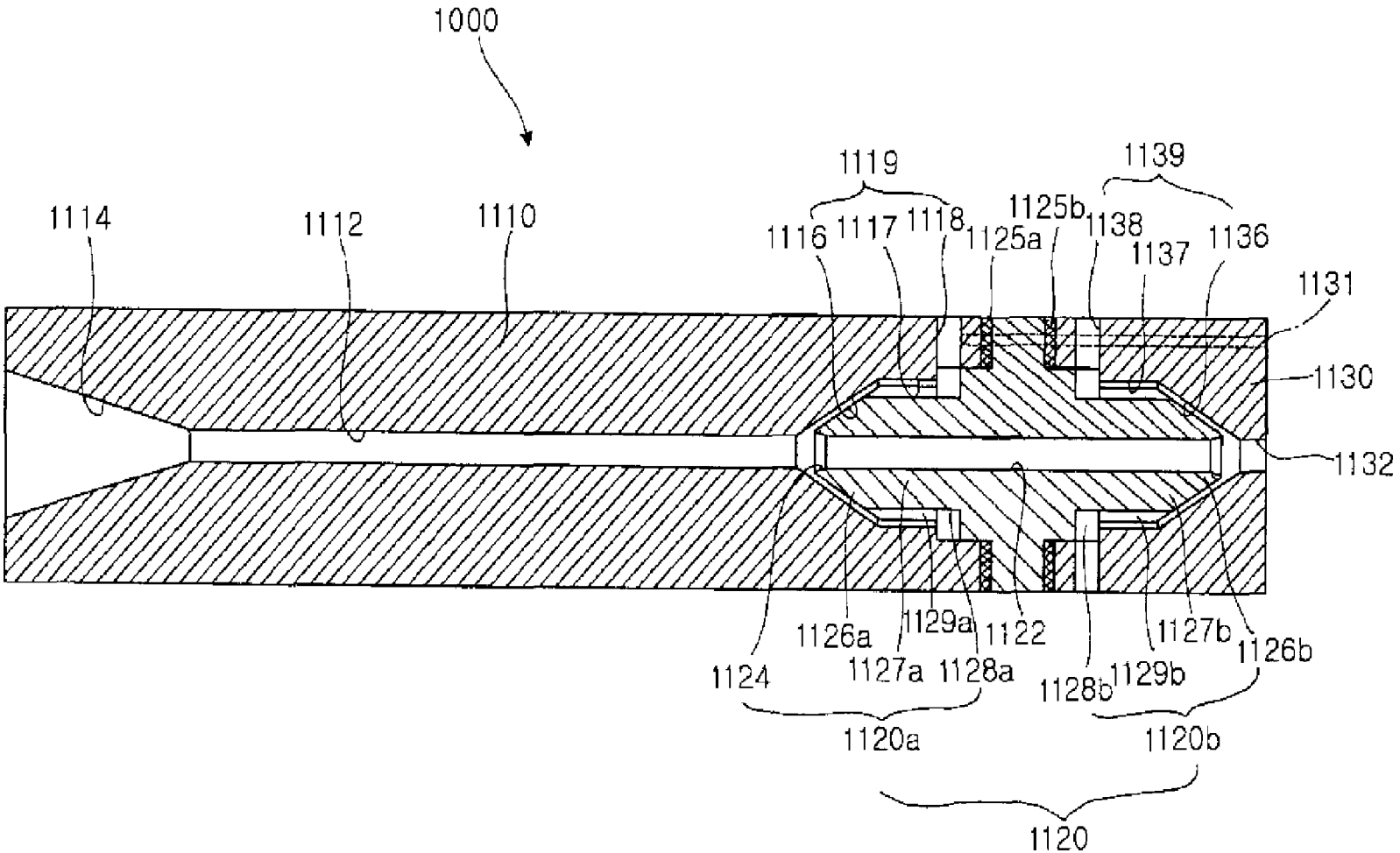

[Fig. 19]
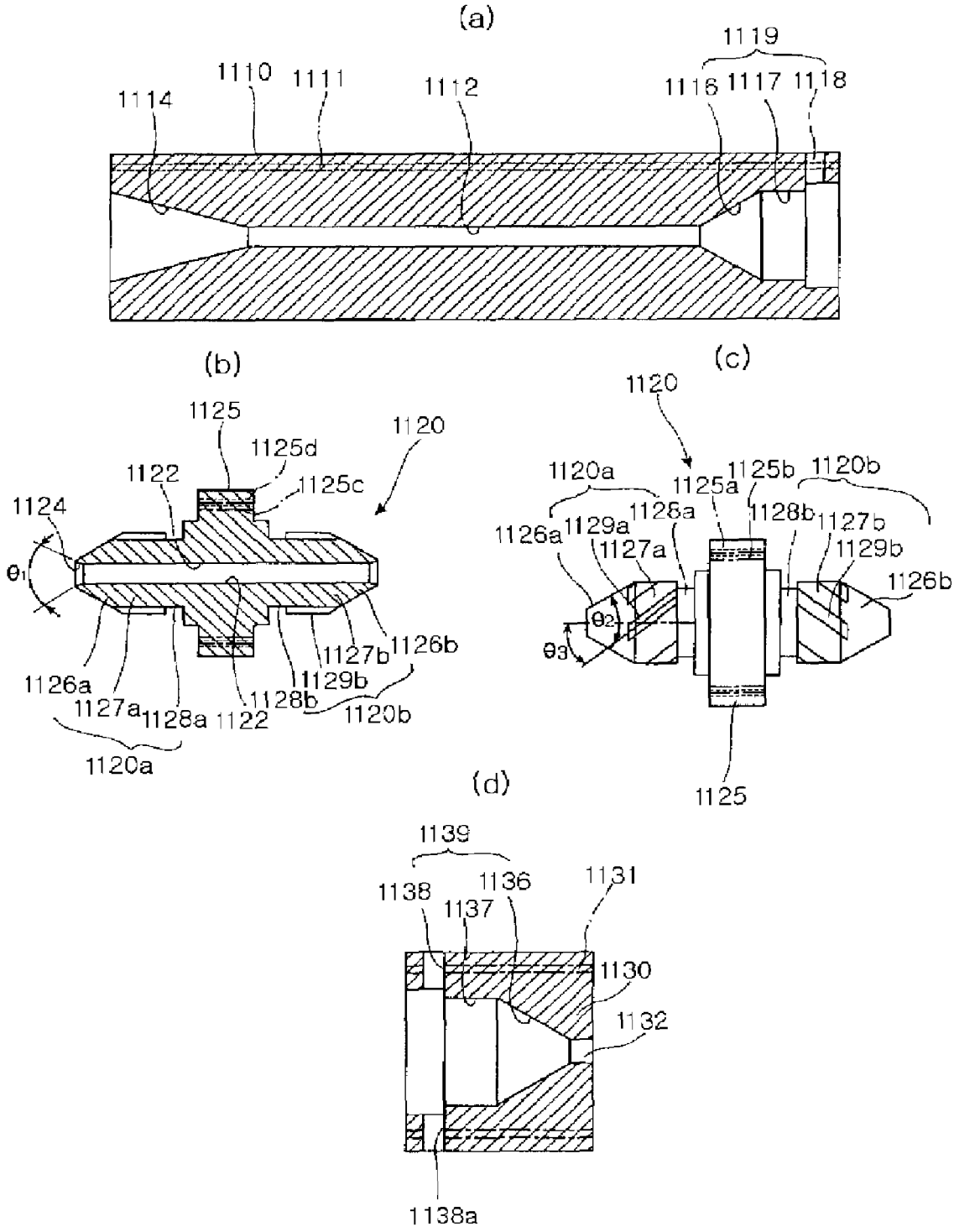

[Fig. 20]
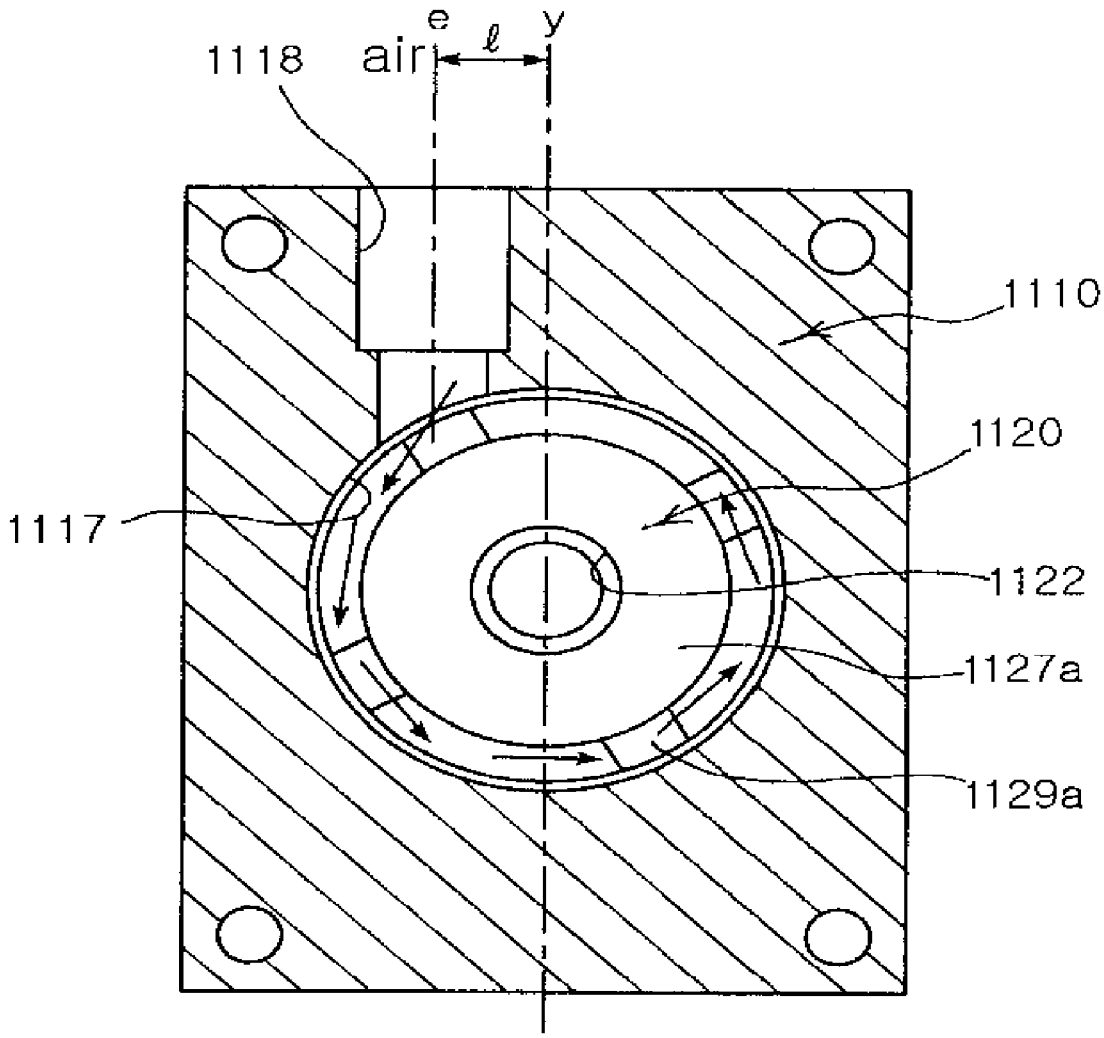

[Fig. 21]
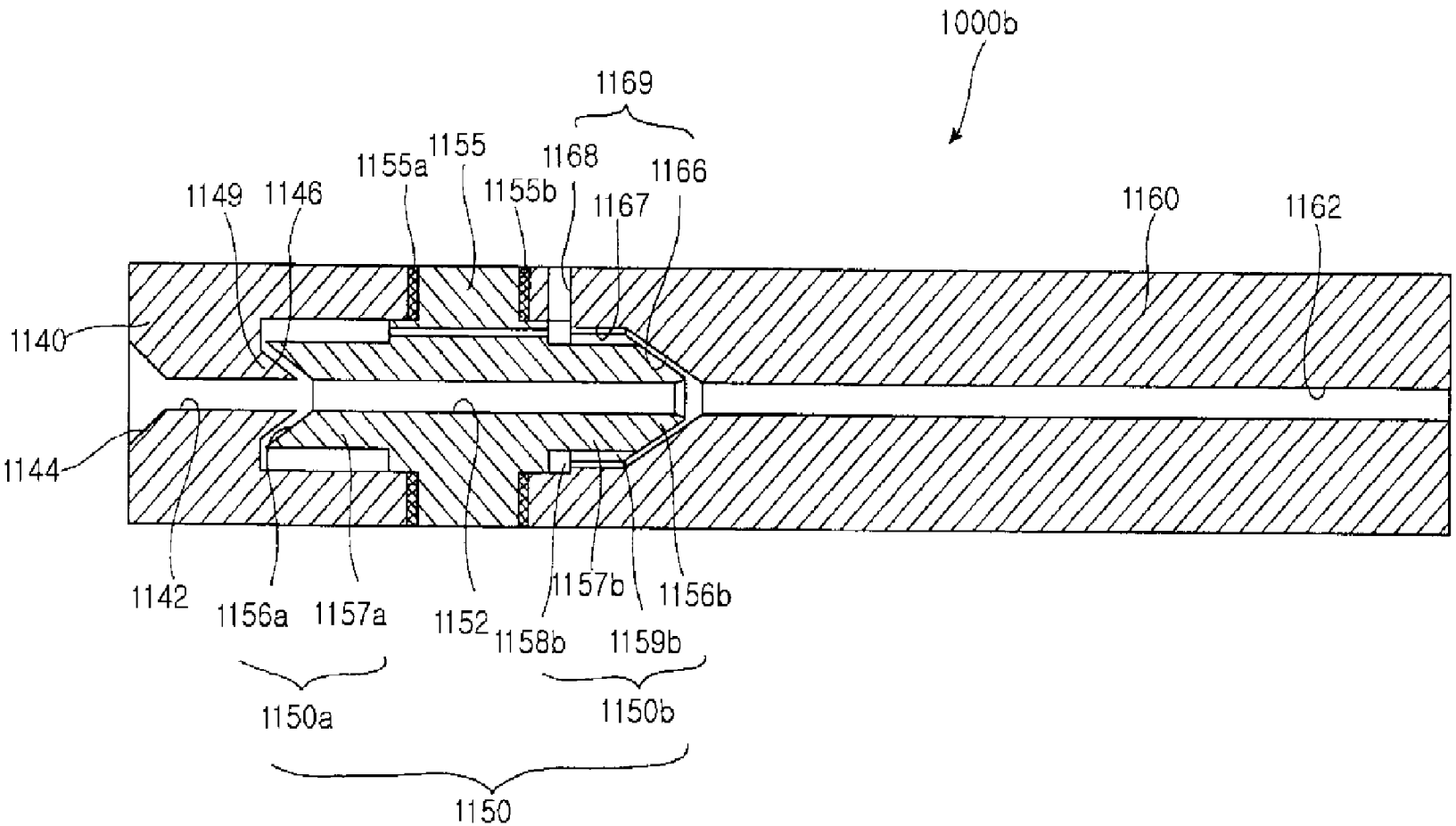

[Fig. 22]
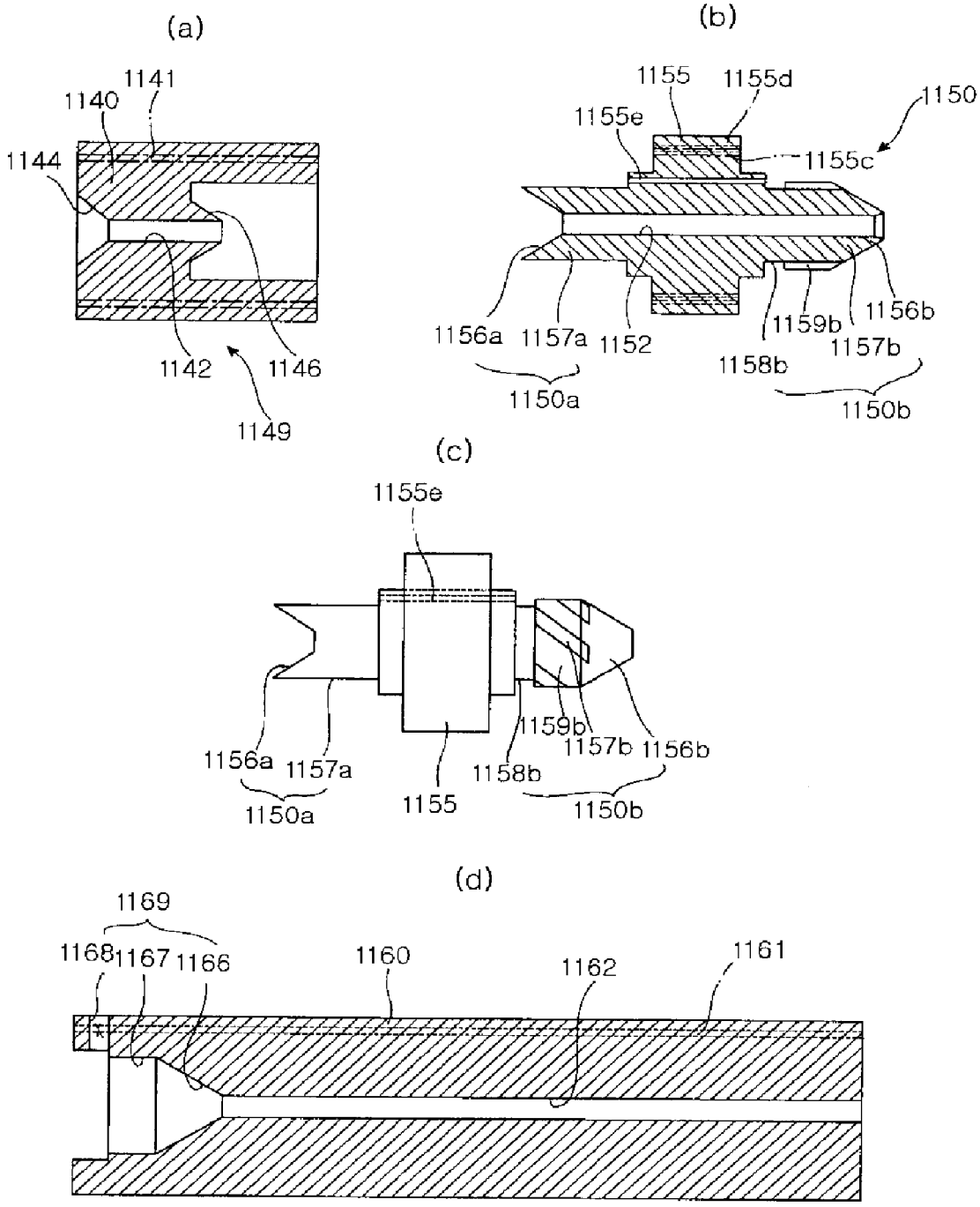

[Fig. 23]
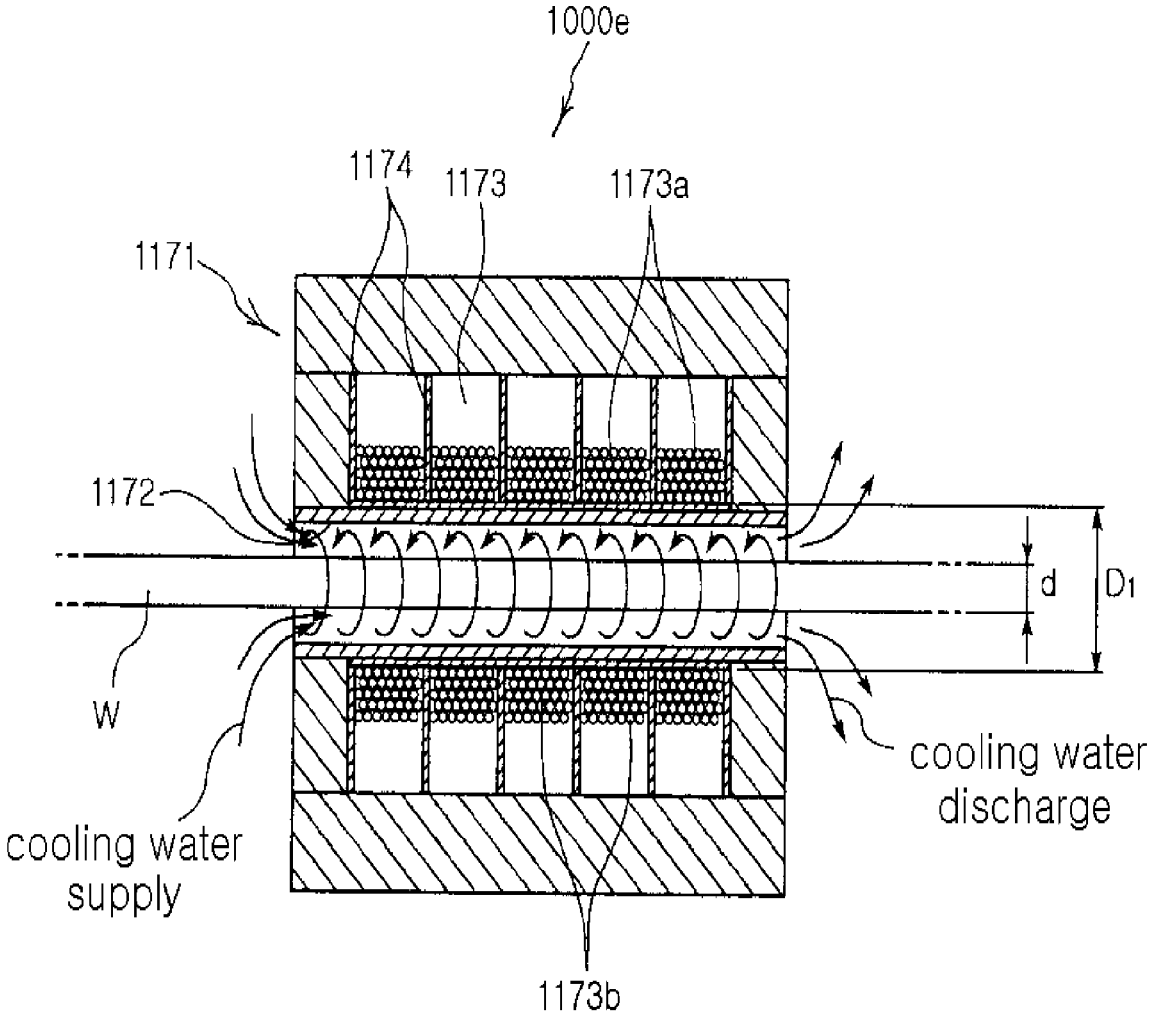

[Fig. 24]
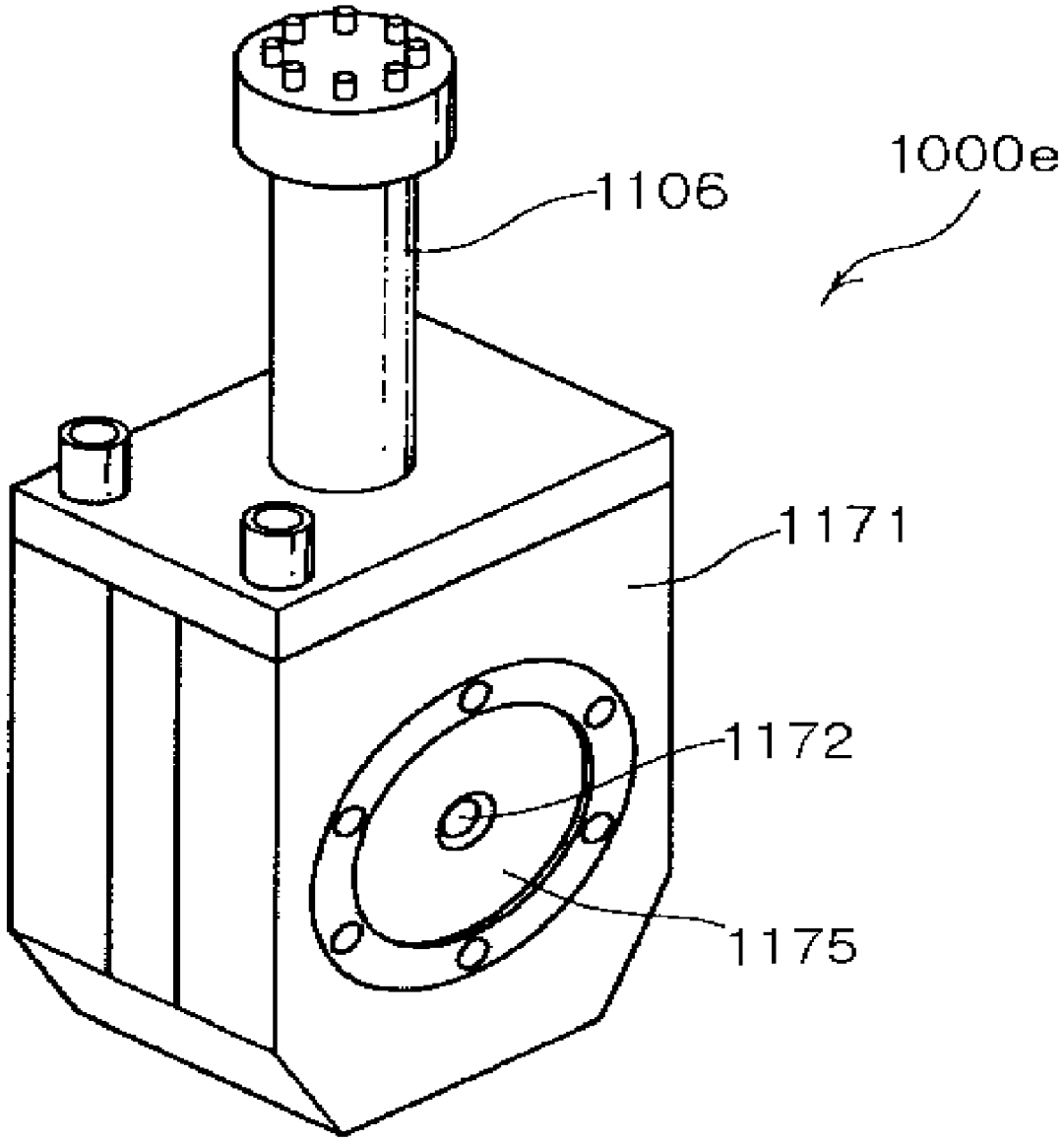

[Fig. 25]
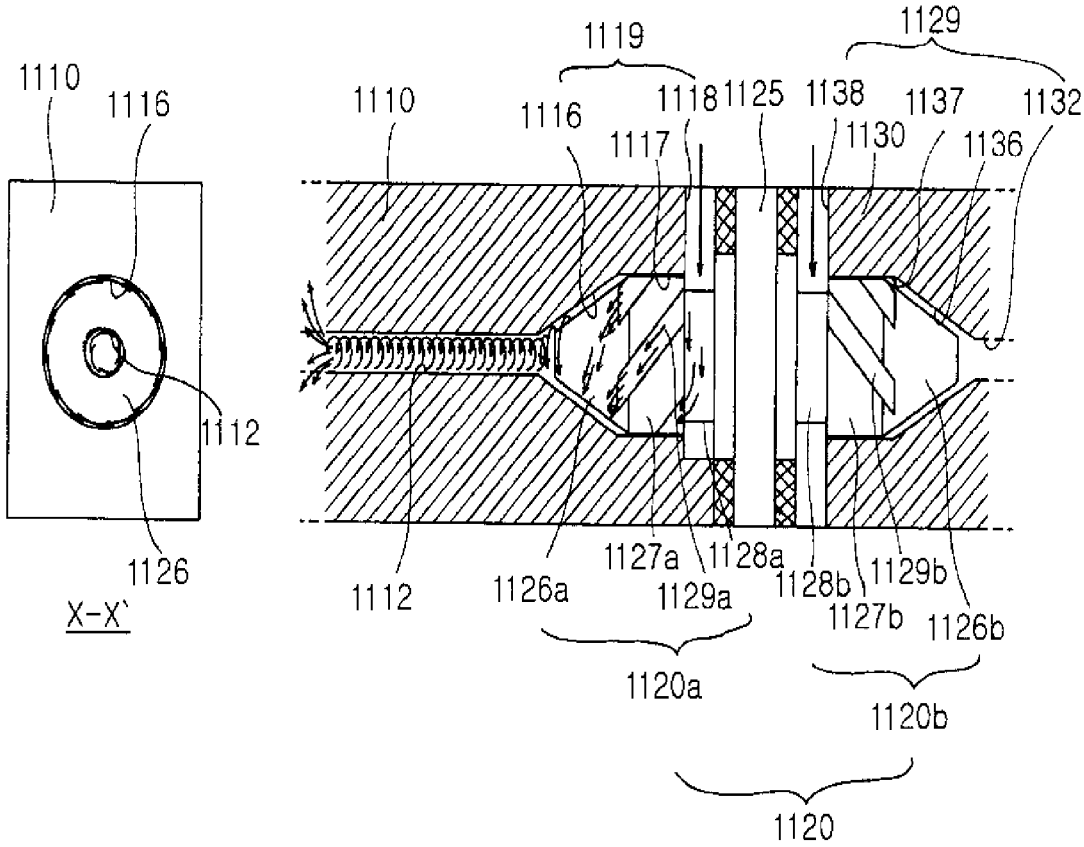

[Fig. 26]
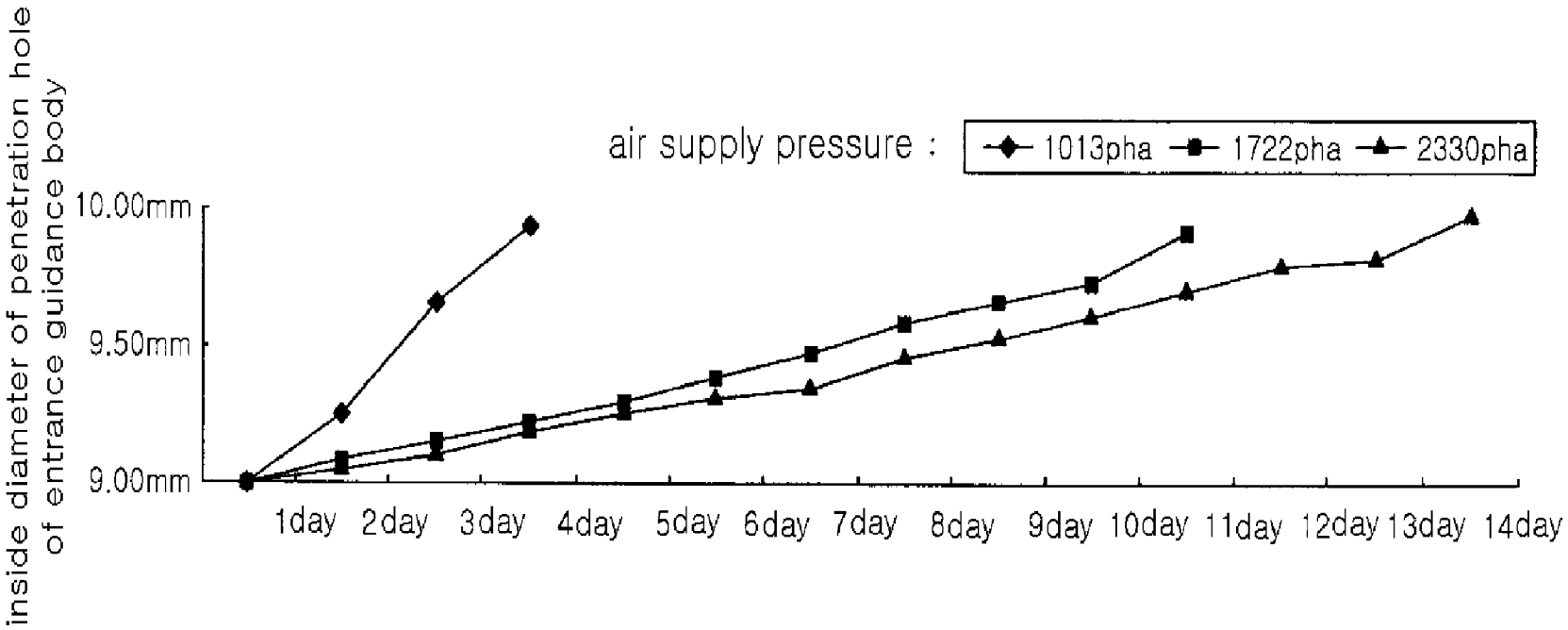

[Fig. 27]
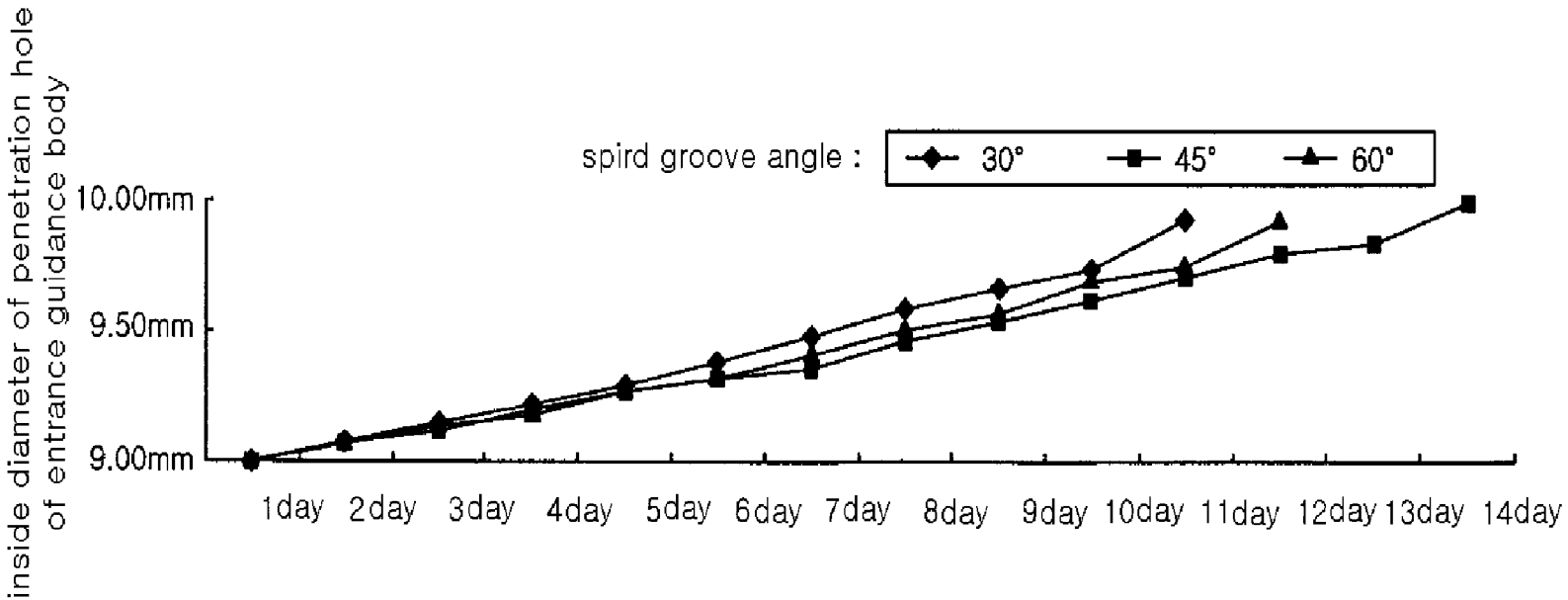

WIRE GUIDER OF AIR GUIDE TYPE

TECHNICAL FIELD

The present invention relates to apparatus for guiding a wire. More particularly, the present invention relates to an air guide type apparatus for detecting surface flaws of a wire rod, which is capable of enabling a more stable one-directional movement of the wire rod by alleviating vibration of the wire rod caused by a thrust force of rolling rolls, reducing surface flaws of the wire rod and wear of guiding facilities by allowing the wire rod to come into minimal contact with guiding passages, achieving an increased load ratio of an eddy current by reducing a distance between the wire rod to be detected and transmitting/receiving coils to the maximum extent, and preventing impurities contained in cooling water from intercepting a cooling path, thereby achieving not only high accuracy and reliability of detection, but also increased cooling efficiency.

BACKGROUND ART

In general, according to a wire rod production process conventionally employed in ironworks, billets as rolling materials (each has a sectional area of 160 mm×160 mm) are first heated in a heating furnace to a rolling temperature of 940~1200° C. Then, the heated billets are sequentially subjected to a plurality of stages of a rolling process including a rough-rolling stage, intermediate rolling stage(s), a finishing-rolling stage, and the like, so as to produce wire rods having a temperature of 800~1000° C. and a diameter of 5.5~42 mm.

Referring to FIG. 1 illustrating a general wire rod production line, once a wire rod W is rolled to have a desired diameter while passing through a finishing-rolling mill 10, the wire rod W is guided to pass through a wire rod guider 20 and a sensor unit 30, which are provided between the finishing-rolling mill 10 and a water cooling device 40 to constitute a detection apparatus 1. Thereby, detection of discontinuous surface flaws of the wire rod W is performed. Thereafter, the wire rod W, having passed through the detection apparatus 1, is primarily cooled to have a temperature of less than approximately 800° C. in the water cooling device 40 and in turn, is secondarily air-cooled to have a temperature of approximately 300~500° C. by use of atmospheric air while being coiled by means of a conical cooling head 50, so as to produce a coil C.

After being subjected to the rolling process, the wire rod W is moved in one direction by a discharge force of the finishing-rolling mill 10. Also, the wire rod W is coiled to constitute a circular coil C by use of a centrifugal force generated by the conical cooling head 50. In this case, it is unavoidable that the wire rod W have a minimal speed error between the discharge speed of the wire rod W from the finishing-rolling mill 10 and the coiling speed of the wire rod W in the conical cooling head 50, due to wire rod rolling characteristics. This inevitably causes the wire rod W to vibrate in a section between the finishing-rolling mill 10 and the conical cooling head 50.

To solve the above described problem, the wire rod guider 20 having a variety of shapes may be provided at a position for detecting surface flaws of the wire rod W, so as to perform not only a function of guiding the movement of the wire rod passing therethrough, but also a function of alleviating the vibration of the wire rod. Well known examples of the wire rod guider include a pipe type wire rod guider, a roller type wire rod guider, and the like.

The wire rod guider 20 is conventionally configured in such a manner that a wire rod passage thereof has an inner diameter is 10~20% smaller than an inner diameter of a detection sensor 31 included in the sensor unit 30, through which the wire rod W passes. This configuration has the effects of preventing the vibrating wire rod W from temporarily coming into contact with an inner portion of the detection sensor 31 and preventing damage to the detection sensor 31.

In the case of a pipe type wire rod guider, it shows excessive frictional contact with the vibrating wire rod and thus, suffers from wear of a pipe through which the wire rod is guided and causes surface scratches on the wire rod. For this reason, recently, roller type wire rod guiders, which are more developed than the pipe type wire rod guider, have been arranged at entrance and exit sides of the sensor unit, respectively, to alleviate vibration of the wire rod.

FIG. 2 is a configuration view illustrating a roller-guide type wire rod guider employed in an apparatus for detecting surface flaws of a wire rod according to the prior art. As shown, the prior art wire rod guider 20 includes an entrance roller guide 20*a* having upper and lower rollers 21 and 22 adapted to externally come into contact with the wire rod W that linearly moves in one direction at an entrance side of the detection sensor 31, and an exit roller guide 20*b* having upper and lower rollers 23 and 34 adapted to externally come into contact with the wire rod W that linearly moves in one direction at an exit side of the detection sensor 31.

Sensor fixing guiders 25 and 26 are provided at the entrance and exit sides of the detection sensor 31, and more particularly, between the entrance roller guide 20*a* and the detection sensor 31 and between the exit roller guide 20*b* and the detection sensor 31, respectively, to accurately guide the movement of the wire rod W.

The entrance and exit roller guides 20*a* and 20*b*, through which the wire rod W passes, have an inner diameter smaller than an inner diameter of the detection sensor 31 and an inner diameter of the sensor fixing guiders 25 and 26, to alleviate vibration of the wire rod W caused by a difference in a movement speed of the wire rod W.

Also, the inner diameter of the sensor fixing guiders 25 and 26 is smaller than the inner diameter of the detection sensor 31, to prevent the wire rod W from coming into contact with an inner surface of the detection sensor 31 when the wire rod W vibrates.

However, the wire rod W may inevitably come into contact with not only the upper and lower rollers 21 and 22 of the entrance roller guide 20*a* provided at an entrance of the sensor unit 30, but also the upper and lower rollers 23 and 24 of the exit roller guide 20*b* provided at an exit of the sensor unit 30 under specific movement speed and vibration conditions of the wire rod W. Therefore, even if the wire rod W is guided so as not to vibrate while guaranteeing smooth rotation of the rollers 21, 22, 23 and 24, there is a problem in that the wire rod W intermittently shows an extremely deteriorated vibration behavior between the entrance roller guide 20*a* and the exit roller guide 20*b*.

As a result of actively studying the reason of the above described vibration behavior, it has been found that the hot rolled wire rod W has elasticity and ductility and thus, is inevitably subjected to a rotating resistance at a portion thereof that comes into contact with the rollers 21, 22, 23 and 24 in the course of passing through the entrance and exit roller guides 20*a* and 20*b* as shown in FIG. 3 and this may cause a movement resistance preventing one-directional movement of the wire rod W.

Accordingly, due to the elasticity and ductility thereof, the wire rod W may vibrate upward and downward following elliptical paths in a sensor section B between the entrance roller guide 20*a* and the exit roller guide 20*b* and in an exit guiding section C between the exit roller guide 20*b* and the water cooling device 40. This causes vibration of the wire rod W. Also, the faster the movement speed of the wire rod W, the greater the vibrating width of the wire rod W.

If a rotating speed of rolling rolls 15 is faster than the movement speed of the wire rod W in the course of moving the rolled wire rod W, having passed through the rolling rolls 15 of the finishing-rolling mill 10, toward the wire rod guider 20, the rolling rolls 15 generate a thrust force that causes the wire rod W to more excessively vibrate upward and downward while following elliptical paths in an entrance guiding section A between the rolling rolls 15 and the entrance roller guide 20*a*.

Therefore, if the wire rod W vibrates by the rotating resistance caused by the rollers and the thrust force generated by the rolling rolls, the wire rod W has a maximum vibrating width within the detection sensor 31 that is disposed at the middle of a longitudinal direction of the sensor section B. The excessive vibration of the wire rod W within the detection sensor 31 imparts serious noise to detection results from the detection sensor 31, resulting in deterioration in the reliability of surface flaw detection for wire rod products.

Furthermore, the excessive vibration of the wire rod W within the detection sensor 31 frequently causes damage to the inner portion of the detection sensor 31. In fact, under a specific production condition in that a wire rod having a diameter of 5.5 mm is rolled at a speed of 100~110 m/s, a normal wire rod detecting operation is impossible and the wire rod suffers from a great amount of surface flaws. As a result, most produced wire rods may have surface flaws and this makes it difficult to commercialize wire rod products.

Meanwhile, referring to FIGS. 4 and 5, the sensor unit 30, which is used to detect surface flaws of the wire rod along with the wire rod guider 20, is shown in detail. As shown in FIGS. 4 and 5, the detection sensor 31 of the sensor unit 30 includes solenoid-type transmitting coils 32, through which an alternating current flows, and solenoid-type receiving coils 33 which are adapted to generate an electric current from a solenoid magnetic field. The detection sensor 31 having the above described configuration acts on the detection of surface flaws of the wire rod W, which moves through the interior of the detection sensor 31 at a high flow rate, on the basis of a variation of an eddy current.

Considering a method for detecting surface flaws of the wire rod W using the detection sensor 31, if an alternating current is applied to the transmitting coils 32, the transmitting coils 32 generate a magnetic field. Thereby, if the wire rod W as a conductor passes through the magnetic field generated by the transmitting coils 32, the magnetic field generated in the coils 32 acts on the wire rod W, thus generating an eddy current over a surface of the wire rod product.

In this case, since the eddy current has an irregular variation due to discontinuous surface flaws generated at the surface of the wire rod product, correspondingly, the eddy current to be applied to the receiving coils 33 of the detection sensor 31 has same irregular variation. The variation value of the eddy current is output on a display unit 39 of a controller that is connected to the detection sensor 31 by use of a cable 35 as shown in FIG. 4. Preferably, for the sake of operator's easy understanding, the variation value of the eddy current is output in the form of a graph.

The detection sensor 31 may experience thermal deformation of a sensor body thereof about a sensor bore 31*a* when the wire rod W having a high temperature of more than 1000° C. passes through the sensor bore 31*a*. For this reason, as shown in FIG. 5, the detection sensor 31 contains a cooling water line 34 defined therein. If cooling water is supplied into the cooling water line 34 as a cooling path, the cooling water performs heat exchange with a coil portion 31*b* in which the transmitting and receiving coils 32 and 33 are arranged by interposing a plurality of partitions 38 therebetween, so as to cool the coil portion 31*b*. Then, the used cooling water is discharged to the outside.

In the above described eddy current detection method using the detection sensor 31, a load ratio (d/D) of the eddy current acts as a main factor of determining the sensitivity of the eddy current. Here, the load ratio (d/D) represents a ratio of an outer diameter d of the wire rod W to an inner diameter D of a winding of the transmitting and receiving coils 32 and 33, which is, in other words, a distance between the surface of the wire rod W and the transmitting and receiving coils 32 and 33. The shorter the distance between the wire rod W and the transmitting and receiving coils 32 and 33, the more the load ratio of the eddy current increase. This results in an improvement in the sensibility of the detection sensor.

However, the detection sensor 31 of the above described prior art sensor unit 30, as shown in FIG. 5, has a structure in that a cooling water passage 34*a* is defined between an outer periphery of the sensor hole 31*a* and an inner surface of the coil portion 31*b* having the transmitting and receiving coils 32 and 33 to extend parallel to the movement direction of the wire rod W. Consequently, the cooling water passage 34*a* acts as a factor of reducing the load ratio in relation to an occupancy volume thereof and therefore, there is a limit to improve the sensitivity of the eddy current.

Further, when any impurities contained in the cooling water are attached to or intercept the cooling water line 34, this prevents smooth flow of the cooling water, thus causing deterioration in the cooling efficiency of the cooling water.

Furthermore, when the impurities are attached to the cooling water passage 34*a* between the sensor hole 31*a* and the transmitting and receiving coils 32 and 33, the impurities may have an adverse influence on the electric current being applied to the receiving coils 33 during the detection of surface flaws for the wire rod, thus causing deterioration in the accuracy and reliability of detection of the wire rod.

Therefore, the present invention has been made in view of the above problems, and it is a first object of the present invention to provide an air guide type apparatus for detecting surface flaws of a wire rod, which can more stably guide one-directional high-speed movement of the wire rod by alleviating vibration of the wire rod caused by a thrust force of rolling rolls.

It is another object of the present invention to provide an air guide type apparatus for detecting surface flaws of a wire rod, which can reduce not only secondary surface flaws of the wire rod, but also wear of wire rod guiding facilities by allowing the wire rod to come into minimal contact with guiding passages.

It is further another object of the present invention to provide an air guide type apparatus for detecting surface flaws of a wire rod, which can reduce surface flaws of the wire rod and prevent wear and damage to the wire rod and a sensor by alleviating vibration of the wire rod when the wire rod is located at a detecting position within the sensor.

It is another object of the present invention to provide an air guide type apparatus for detecting surface flaws of a wire rod, which can achieve high accuracy and reliability in the surface detection of the wire rod by minimizing noise of a sensor that is used to detect a surface of the wire rod being guided.

It is further another object of the present invention to provide an air guide type apparatus for detecting surface flaws of a wire rod, which can increase a load ratio of an eddy current by reducing a distance between the wire rod to be detected and transmitting/receiving coils to the maximum extent.

SUMMARY OF THE INVENTION

According to an aspect of the invention for realizing the object, the invention provides a wire guider of air guide type for guiding a wire which is press-rolled and run in a predetermined direction to damp vibration of the wire. The pwire guider of air guide type includes a guiding unit having an inner path extending along the running direction of the wire to guide the running of the wire. The inner path has an inside diameter larger than an outside diameter of the wire. The pneumatic wire guide system also includes an air supply unit for supplying air into the inner path to form a spiral air flow having a speed faster than a running rate of the wire between an outer surface of the wire and an inner surface of the inner path.

Preferably, the pneumatic wire guide system may further include a sensor unit arranged in the guiding unit to inspect the wire, in which the guiding unit includes an entrance guider arranged at an entrance side of the sensor unit and an exit guider arranged at an exit side of the sensor unit.

More preferably, the entrance guider includes an entrance guider body and an entrance screw; in which the entrance guider body has a through hole which the wire passes through, a screw assembling part arranged at a rear end of the through hole with an inside diameter increasing along the running direction of the wire and an air inlet hole communicating with the screw assembling part. The entrance screw has a central hole conforming to the through hole of the entrance guider by, and is assembled to a rear end of the entrance guider body to form an air path communicating the air inlet hole and the through hole between an inner surface of the screw assembling part and an outer surface of the entrance screw body.

More preferably, the through hole has a first wire guide area formed at a front end, and the first wire guide area has an inside diameter increasing gradually along the running direction of the wire.

More preferably, the central hole has a second wire guide area formed at a front end, and the second wire guide area has an inside diameter increasing gradually along the running direction of the wire.

More preferably, the screw assembling part has an inside slope with an inside diameter increasing along the running direction of the wire and an inside cylindrical surface exposing a bottom end of the air inlet hole, the inside cylindrical surface has an inside diameter remaining constant along the running direction of the wire, and the entrance screw has a corn corresponding to the inside slope of the screw assembling part and a cylinder having a plurality of spiral grooves formed in an outer surface corresponding to the inside cylindrical surface of the screw assembling part and an air guide groove formed an outer surface corresponding to the air inlet hole.

More preferably, entrance screw further has a flange at a rear end of the cylinder, and the flange is assembled to the rear end of the entrance guider body.

More preferably, the entrance screw further has at least one spacer arranged between the entrance guider body and the flange to allow adjustment in gap size between the inner slope of the screw assembling part and the corn of the entrance screw.

More preferably, the spiral grooves are extended to an outer surface of the corn.

More preferably, the air inlet hole is located on an eccentric axis spaced at a pre-determined distance from a vertical axis passing a center of the central hole.

Preferably, the exit guider includes an exit guider body and an exit screw, in which the exit guider body has a through hole which the wire passes through, a screw assembling part arranged at a rear end of the through hole with an inside diameter decreasing along the running direction of the wire and an air inlet hole communicating with the screw assembling part. The exit screw has a central hole conforming to the through hole of the exit guider body, and is assembled to a front end of the exit guider body so that air introduced from the air inlet hole forms an air path feeding to the through hole between an inner surface of the screw assembling part and an outer surface of the exit screw body.

More preferably, the exit screw has a third wire guide area at a front end of the central hole, the third wire guide area having an inside diameter increasing gradually along the running direction of the wire.

More preferably, the screw assembling part has an inner cylindrical surface and an inner slope, the inner cylindrical surface having an inner diameter remaining constant along the running direction of the wire and exposing a bottom end of the air inlet hole, the inner slope has an inside diameter decreasing along the running direction of the wire, and the exit screw has a cylinder and a corn, the cylinder has a plurality of spiral grooves in an outer surface corresponding to the inner cylindrical surface of the screw assembling part and an air guide groove in an outer surface corresponding to the air inlet hole of the exit guider body, and the corn corresponds to the inner slope of the screw assembling part.

More preferably, the exit screw further has a flange at a front end of the cylinder, the flange assembled to a front end of the exit guider body.

More preferably, the exit screw further has at least one spacer arranged between the exit guider body and the flange to allow adjustment in gap size between the inner slope of the screw assembling part and the corn of the exit screw.

More preferably, the spiral grooves are extended to an outer surface of the exit screw.

More preferably, the air inlet hole is located on an eccentric axis spaced at a pre-determined distance from a vertical axis passing a center of the central hole.

Preferably, the wire guider of air guide type may further include a sensor fixing part arranged between the entrance and exit guiders to fixedly locate the sensor unit, in which the sensor fixing part includes an entrance sensor fixing guider mounted at an entrance face of the sensor unit where the wire enters the sensor unit, the entrance sensor fixing guider having a through hole which the wire passes through, and an exit sensor fixing guider mounted at an exit face of the sensor unit where the wire exits the sensor unit, in which the exit sensor fixing guider has a through hole which the wire passes through.

More preferably, the entrance sensor fixing guider has a fourth wire guide area in a front end of the through hole, and the fourth wire guide area has an inside diameter increasing along the running direction of the wire.

More preferably, the exit sensor fixing guider has a fifth wire guide area in a front end of the through hole, and the fifth wire guide area has an inside diameter decreasing along the running direction of the wire.

More preferably, the entrance and exit sensor fixing guiders are fixedly located on a base where the entrance and exit guiders are fixed.

More preferably, the entrance sensor guide is arranged at a predetermined gap from a rear end of the entrance guider.

More preferably, the exit sensor guide is arranged at a predetermined gap from a front end of the exit guider.

More preferably, the entrance guider is assembled at a rear end to contact an entrance face of the sensor unit where the wire enters the sensor unit.

More preferably, the exit guider is assembled at a front end to contact an exit face of the sensor unit where the wire exits the sensor unit.

Preferably, the sensor unit comprises a test sensor for detecting surface defects of the wire using eddy current.

Preferably, the sensor unit comprises a camera for detecting surface defects of the wire by images.

Preferably, the entrance guider comprises a roller type guide having upper and lower rollers contacting outer surfaces of the running wire at the entrance side of the sensor unit.

Also preferably, the exit guider comprises a roller type guide having upper and lower rollers contacting outer surfaces of the running wire at the exit side of the sensor unit.

In accordance with another aspect of the present invention, the above and other objects can be accomplished by the provision of an wire guider of air guide type for detecting surface flaws of a rolled wire rod having passed through a rolling mill, the wire guider of air guide type comprising a sensor unit to detect the surface flaws of the wire rod while guiding one-directional movement of the wire rod, further comprising: an entrance guider having an inner passage perforated therethrough to have an inner diameter larger than an outer diameter of the wire rod, the entrance guider being provided at an entrance of the sensor unit; an exit guider having an inner passage perforated therethrough to have an inner diameter larger than the outer diameter of the wire rod, the exit guider being provided at an exit of the sensor unit; an air supply unit for supplying air into the inner passages of the entrance and exit guiders, so as to create a spiral air flow having a higher flow rate than a movement speed of the wire rod between an outer surface of the wire rod and inner surfaces of the inner passages perforated through the entrance and exit guiders; and a cooling water supply unit for providing cooling water between the wire rod and a sensor bore perforated in the sensor unit for the passage of the wire rod, so as to externally cool the sensor bore.

Preferably, the entrance guider may comprise: an entrance guiding body having a first through-bore perforated in the center of the body to allow the passage of the wire rod; an entrance screw member having a center bore coinciding with the first throughbore; and an entrance sensor fixing guider having a second through-bore perforated therethrough to allow the passage of the wire rod, the entrance sensor fixing guider being mounted at an entrance surface of the sensor unit.

More preferably, the entrance guiding body may comprise: a first screw member assembling portion formed at a rear end of the first through-bore, the first screw member assembling portion having a cross section in which an inner diameter thereof increases in a forward movement direction of the wire rod; and a first air inlet hole connected to the first screw member assembling portion.

Preferably, the entrance sensor fixing guider may comprise: a second screw member assembling portion formed at a front end of the second through-bore, the second screw member assembling portion having a cross section in which an inner diameter thereof decreases in the forward movement direction of the wire rod; and a second air inlet hole and a cooling water inlet hole connected to the second screw member assembling portion.

Preferably, the entrance screw member may comprise: a front entrance screw member defining an air passage with an inner surface of the first screw member assembling portion; and a rear entrance screw member defining another air passage with an inner surface of the second screw member assembling portion, whereby the entrance screw member is assembled between the entrance guiding body and the entrance sensor fixing guider.

More preferably, a first wire rod guiding portion may be formed at a front end of the first through-bore, and may have a cross section in which an inner diameter thereof gradually decreases in a forward movement direction of the wire rod.

More preferably, a second wire rod guiding portion may be formed at a front end of the center bore, and may have a cross section in which an inner diameter thereof gradually decreases in a forward movement direction of the wire rod.

More preferably, the first screw member assembling portion may comprise: an inner inclined surface to provide the first screw member assembling portion with a cross section in which the inner diameter of the first screw member assembling portion increases in the forward movement direction of the wire rod; and an inner circumferential surface to provide the first screw member assembling portion with a cross section in which the inner diameter of the first screw member assembling portion is constant in the forward movement direction of the wire rod, a lower end of the first air inlet hole being exposed at the inner circumferential surface.

More preferably, the second screw member assembling portion may comprise: an inner circumferential surface to provide the second screw member assembling portion with a cross section in which the inner diameter of the second screw member assembling portion is constant in the forward movement direction of the wire rod, lower ends of the second air inlet hole and cooling water inlet hole being exposed at the inner circumferential surface; and an inner inclined surface to provide the second screw member assembling portion with a cross section in which the inner diameter of the second screw member assembling portion decreases in the forward movement direction of the wire rod.

More preferably, the front entrance screw member may comprise: a front conical portion corresponding to an inner inclined surface of the first screw member assembling portion; and a front cylindrical portion having a spiral groove and an air guiding groove formed at an outer surface thereof corresponding to an inner circumferential surface of the first screw member assembling portion, the air guiding groove being formed to correspond to a first air inlet hole, and the rear entrance screw member may comprise: a rear conical portion corresponding to an inner inclined surface of the rear screw member assembling portion; and a rear cylindrical portion having a spiral groove and an air guiding groove formed at an outer surface thereof corresponding to an inner circumferential surface of the second screw member assembling portion, the air guiding groove being formed to correspond to a second air inlet hole and cooling water inlet hole.

More preferably, the entrance screw member further may comprise a flange portion to integrally connect front and rear cylindrical portions of the front and rear entrance screw members to each other.

More preferably, the flange portion may comprise a plurality of fastening holes to allow the entrance screw member to be assembled to the entrance guiding body and the entrance sensor fixing guider by use of a plurality of fastening members.

More preferably, at least one spacer may be provided between the entrance guiding body and the flange portion and adapted to regulate the size of a gap defined between an inner inclined surface of the first screw member assembling portion and a front conical portion of the front entrance screw member.

More preferably, at least one spacer may be provided between the entrance sensor fixing guider and the flange portion and adapted to regulate the size of a gap defined between an inner inclined surface of the second screw member assembling portion and a rear conical portion of the rear entrance screw member.

More preferably, the spiral grooves of the front and rear cylindrical portions may extend over outer surfaces of the front and rear conical portions, respectively.

More preferably, each of the first and second air inlet holes and the cooling water inlet hole may be positioned on an eccentric axis, which is spaced apart from a vertical axis passing through the center of the center bore by a predetermined distance.

Preferably, the exit guider may comprise: an exit sensor fixing guider having a third through-bore perforated therethrough to allow the passage of the wire rod, the exit sensor fixing guider being mounted at an exit surface of the sensor unit; an exit screw member having a center bore coinciding with the third through-bore; and an exit guiding body having a fourth through-bore perforated therethrough to allow the passage of the wire rod.

More preferably, the exit sensor fixing guider may comprise a third screw member assembling portion formed at a rear end of the third through-bore, the third screw member assembling portion having a cross section in which an outer diameter thereof decreases in a forward movement direction of the wire rod.

More preferably, the exit guiding body may comprise: a fourth screw member assembling portion formed at a front end of the fourth through-bore, the fourth screw member assembling portion having a cross section in which an inner diameter thereof increases in the forward movement direction of the wire rod; and a third air inlet hole connected to the fourth screw member assembling portion.

More preferably, the exit screw member may comprise: a front exit screw member defining an air passage with an outer surface of the third screw member assembling portion; and a rear exit screw member defining another air passage with an inner surface of the fourth screw member assembling portion, whereby the exit screw member is assembled between the exit sensor fixing guider and the exit guiding body.

More preferably, a third wire rod guiding portion may be formed at a front end of the third through-bore, and may have a cross section in which an inner diameter thereof gradually decreases in a forward movement direction of the wire rod.

More preferably, the third screw member assembling portion may comprise a conical portion having a cross section in which an outer diameter thereof decreases in the forward movement direction of the wire rod.

More preferably, the fourth screw member assembling portion may comprise: an inner circumferential surface to provide the fourth screw member assembling portion with a cross section in which the inner diameter of the fourth screw member assembling portion is constant in the forward movement direction of the wire rod, a lower end of the third air inlet hole being exposed at the inner circumferential surface; and an inner inclined surface to provide the fourth screw member assembling portion with a cross section in which the inner diameter of the fourth screw member assembling portion decreases in the forward movement direction of the wire rod.

More preferably, the front exit screw member may comprise a front cylindrical portion having an inner inclined surface formed in a front end region of the center bore to correspond to a conical portion of the third screw member assembling portion, and the rear exit screw member may comprise: a rear conical portion configured to correspond to an inner circumferential surface of the fourth screw member assembling portion; and a rear cylindrical portion having a spiral groove and air guiding groove formed at an outer surface thereof corresponding to an inner circumferential surface of the fourth screw member assembling portion, the air guiding groove being formed to correspond to a third air inlet hole of the exit guiding body.

More preferably, the exit screw member may further comprise a flange portion to integrally connect front and rear cylindrical portions of the front and rear exit screw members to each other.

More preferably, the flange portion may comprise a plurality of fastening holes to allow the exit screw member to be assembled to the exit guiding body and the exit sensor fixing guider by use of a plurality of fastening members.

More preferably, the flange portion may comprise at least one connecting hole to connect an air passage between the third screw member assembling portion and the exit front screw member to an air guiding groove.

More preferably, at least one spacer may be provided between the exit sensor fixing body and the flange portion and adapted to regulate the size of a gap defined between an outer inclined surface of the third screw member assembling portion and the center bore of a front cylindrical portion of the front exit screw member.

More preferably, at least one spacer may be provided between the exit guiding body and the flange portion and adapted to regulate the size of a gap defined between a rear conical portion and an inner inclined surface of the fourth screw member assembling portion.

More preferably, the spiral groove may extend over an outer surface of the rear conical portion.

More preferably, the third air inlet hole may be positioned on an eccentric axis, which is spaced apart from a vertical axis passing through the center of the center bore by a predetermined distance.

Preferably, the sensor unit may comprise a detection sensor to detect the surface flaws of the wire rod based on a variation of an eddy current.

More preferably, the detection sensor may comprise a plurality of transmitting and receiving coils, which are alternately arranged to surround the sensor bore perforated therethrough for the passage of the wire rod.

Preferably, the sensor unit may be an image camera for detecting the surface flaws of the wire rod by capturing images of the surface flaws.

Preferably, the entrance guider may be a roller type guider comprising upper and lower rollers, which are arranged to come into external contact with the wire rod being moved in one direction at the entrance of the sensor unit.

Preferably, the exit guider may be a roller type guider comprising upper and lower rollers, which are arranged to come into external contact with the wire rod being moved in one direction at the exit of the sensor unit.

The present invention provides an wire guider of air guide type for detecting surface flaws of a wire rod having the following effects.

By supplying high-pressure air into inner passages of entrance and exit guiders to allow the air to be swirled in the inner passages, the present invention has the effects of achieving a considerable reduction in vibration of a wire rod, resulting in a remarkable reduction in surface flaws of the wire rod and wear of the guiders.

With the provision of the air swirl, it is possible to remove secondary scale on a surface of the wire rod and consequently, to prevent formation of secondary scale on a sensor unit. Also, the air swirl can serve to push the wire rod toward the exit, thereby more efficiently reducing vibration of the wire rod.

By virtue of an air film formed at an inner wall surface of a through-bore of each guiding body by the air swirl, the present invention has the effect of improving the reliability of a sensor unit.

The wire guider of air guide type of the present invention can stably guide the wire rod without the risk of damage and excessive wear of relevant guiding facilities, thereby achieving a remarkable reduction in the generation of surface flaws of the wire rod and, resulting in an improvement in the quality of wire rod products.

Externally cooling a sensor bore in the sensor unit by use of cooling water has the effect of reducing a distance between the wire rod to be detected and transmitting and receiving coils of a sensor and consequently, increasing a load ratio of an eddy current. As a result, the sensor can achieve a higher detection sensitivity and accuracy as compared to the prior art in which the cooling water line is embedded in the sensor.

Furthermore, according to the present invention, it is possible to prevent impurities contained in cooling water from intercepting a cooling water flow path. This guarantees stabilized flow of the cooling water, resulting in an improvement in the cooling efficiency as well as the accuracy and reliability of detection of the wire rod.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a configuration view illustrating a general wire rod production line;

FIG. 2 is a configuration view illustrating a roller-guide type apparatus for detecting surface flaws of a wire rod according to the prior art;

FIG. 3 is a state view of the prior art roller-guide type detection apparatus of FIG. 2, which undergoes vibration;

FIG. 4 is a state view illustrating a detection apparatus provided in the general wire rod production line, which performs an operation for detecting surface flaws of a wire rod;

FIG. 5 is a sectional view illustrating an internal cooling type apparatus for detecting surface flaws of a wire rod according to the prior art;

FIG. 6 is a perspective view illustrating a wire manufacturing line adopting a wire guider of air guide type according to the invention;

FIG. 7 is an overall configuration view illustrating a wire guider of air guide type according to the invention;

FIG. 8 is a longitudinal perspective view illustrating an entrance guider of the wire guider of air guide type according to the invention;

FIG. 9 illustrates the entrance guider of the wire guider of air guide type according to the invention, in which (a) is a sectional view of an entrance guider body, (b) is a sectional view of an entrance screw, and (c) is side elevation view of the entrance screw;

FIG. 10 is a partial sectional top view illustrating a part of the wire guider of air guide type according to the invention, in which air is being supplied through an air inlet hole of the entrance guider of the wire guider of air guide type;

FIG. 11 is a longitudinal sectional view illustrating entrance guider of the wire guider of air guide type of the invention;

FIG. 12 illustrates the exit guider of the wire guider of air guide type according to the invention, in which (a) is a sectional view of an exit guider body, (b) is a sectional view of an exit screw, and (c) is side elevation view of the exit screw;

FIG. 13 illustrates the sensor unit and an entrance or exit sensor fixing guider of the wire guider of air guide type according to the invention, in which (a) is a perspective views of the sensor unit, and (b) is a perspective view of the entrance or exit sensor fixing guider;

FIG. 14 illustrates air flows in the entrance guider of the wire guider of air guide type according to the invention, in which (a) shows the air flow without the wire passing through the entrance guider, and (b) shows the air flow with the wire passing through the entrance guider;

FIG. 15 is end views (a) to (c) illustrating various positions where the wire is located in the entrance guider body of the entrance guider of the wire guider of air guide type according to the invention;

FIG. 16 is a configuration view illustrating a process of measuring surface defects of the wire by a test sensor using eddy current in the wire guider of air guide type according to the invention;

FIG. 17 is an overall configuration view illustrating a wire guider of air guide type according to another embodiment the invention;

FIG. 18 is a longitudinal sectional view illustrating an entrance guider employed the wire guider of air guide type according to another embodiment the present invention;

FIG. 19(*a*) to 19(*d*) illustrate the entrance guider of FIG. 18, in which FIG. 19(*a*) is a longitudinal sectional view of an entrance guiding body, FIG. 19(*b*) is a longitudinal sectional view of an entrance screw member, FIG. 19(*c*) is an outer appearance view of the entrance screw member, and FIG. 19(*d*) is a longitudinal sectional view of an entrance sensor fixing guider;

FIG. 20 is a longitudinal sectional view illustrating an air inlet hole formed the wire guider of air guide type according to another embodiment the present invention;

FIG. 21 is a longitudinal sectional view illustrating an exit guider employed the wire guider of air guide type according to another embodiment the present invention;

FIG. 22(*a*) to 22(*d*) illustrate the exit guider of FIG. 21, in which FIG. 22(*a*) is a longitudinal sectional view of an exit sensor fixing guider, FIG. 22(*b*) is a longitudinal sectional view of an exit screw member, FIG. 22(*c*) is an outer appearance view of the exit screw member, and FIG. 22(*d*) is a longitudinal sectional view of an exit guiding body;

FIG. 23 is a state view illustrating a process for detecting surface flaws of a wire rod using a sensor unit employed the wire guider of air guide type according to another embodiment the present invention;

FIG. 24 is an outer appearance view illustrating the sensor unit of FIG. 23;

FIG. 25 is a detailed view illustrating the flow of air in the entrance guider provided the wire guider of air guide type according to another embodiment the present invention;

FIG. 26 is a graph illustrating the variation of wear in the entrance guider depending on the variation of an air supply pressure; and FIG. 27 is a graph illustrating the variation of wear in the entrance guider depending on the variation of an inclination angle of a spiral groove.

BEST MODE FOR CARRYING OUT THE INVENTION

The present invention will be now described in more detail with reference to accompanying drawings.

FIG. 6 is a perspective view illustrating a wire manufacturing line adopting a wire guider of air guide type according to the invention, and FIG. 7 is an overall configuration view illustrating the wire guider of air guide according to the invention.

Referring to FIGS. 6 and 7, the pneumatic wire guide system 100 of the invention is installed between a finishing mill and a water cooling unit to guide a mill-rolled wire W running in a predetermined direction in order to damp any vibration of the wire W. The pneumatic wire guide system 100 generally includes a guiding unit 100*a* and air supply units 100*b*.

The guiding unit 100*a* has an inner path extending along the running direction of the wire W to guide the running of the wire W, in which the inner path has an inside diameter larger than an outside diameter of the wire W.

The air supply units 100*b* are configured to force air into the inner path to form a spiral air flow having a current rate faster than a running rate of the wire W between the outer surface of the wire W and the inner surface of the inner path.

This arrangement is devised to minimize or eliminate any contact between the wire W and the guiding unit in the inner path, through which the wire W runs, in order to prevent surface defects of the wire while protecting the guiding unit from damages.

That is, the guiding unit 100*a* includes an entrance guider 101 and an exit guider 102. The entrance guider 101 is provided at the entrance side of a sensor unit 150, which inspects surface conditions of the wire W running in one direction, to guide the wire W entering the sensor unit 150. The exit guider 102 is provided at the exit side of the sensor unit 150 to guide the wire W exiting from the sensor unit 150.

<entrance guider>

The entrance guider 101 includes an entrance guider body 110 and an entrance screw 120 as shown in FIGS. 8 and 9(*a*) to (*c*).

The entrance guider body 110 has a through hole 112 perforated in the running direction of the wire W and a screw assembling part 119 provided at a rear end of the through hole 112 where the wire W exits. The through hole 112 has an inside diameter larger than the outside diameter of the wire W to allow passage of the wire W running in one direction. Referring to the cross-section of the screw assembling part 119, the inside diameter increases gradually along the running direction of the wire W. An air inlet hole 118 is perforated in the screw assembling part 119 to connect with an air supply line 103*a* adapted to supply high pressure compressed air.

The inlet screw 120 has a central hole 122 perforated in the wire running direction. The central hole 122 is arranged coaxial with the through hole 112 of the entrance guider body 110 and has an inside diameter the same as that of the through hole 112. The entrance screw 120 is assembled to the rear end of the entrance guider body 110 with a predetermined gap between the inner surface of the screw assembling part 119 and the outer surface of the entrance screw 120 so as to leave an air path for communicating the air inlet hole 118 with the through hole 112.

The entrance guider body 110 also has a first wire guide area 114 at a front end of the through hole 112. The first wire guide area 114 is shaped as a bellmouth, that is, has the inside diameter increasing gradually along the running direction of the wire W.

With the first wire guide area 114 having the inside diameter enlarged beyond that of the through hole 112, at the early introduction stage of the wire W, the leading end of the wire W can more easily enter the entrance guider 101 without obstruction.

The screw assembling part 119, at the rear end of the entrance guider body 110, is provided with an inner slope 116 and an inner cylindrical surface 117 continuously along the running direction of the wire W. The inside diameter increases at the inner slope 116 but remains at the inner cylindrical surface 117 along the running direction of the wire W. The inner cylindrical surface 117 exposes the bottom end of the air inlet hole 118.

The entrance screw 120 assembled to the screw assembling part 119 described just above is provided with a cone 126 and a cylinder 127 continuously along the running direction of the wire W. The outer surface of the cone 126 opposes the inner slope 116 with a predetermined gap, and the cylinder 127 has spiral grooves 127*a* formed in the outer surface opposing the inner cylindrical surface 117 with a predetermined gap. The cylinder 127 is provided with an annular air guide groove 128 in the outer surface, corresponding to the air inlet hole 118, in which the air guide groove 128 is configured to communicate with the spiral grooves 127*a*.

With this arrangement, high pressure compression air forced through the air inlet hole 118 is introduced into the spiral grooves 127*a* via the guide groove 128. The air flowing through the spiral grooves 127*a* is supplied into the through hole 112 of the entrance guider body 110 while being converted into a swirl between the inner surface of the screw assembling part 119 and the outer surface of the entrance screw 120. The air flow is directed counter to the running direction of the wire W passing through the through hole 112.

At the rear end of the cylinder 127, a flange 125 is provided with a plurality of fastening holes 125*a* perforated therethrough so that the entrance screw 120 can be assembled to the rear end of the entrance guider body 110 by means of fastening members 125*b*.

Preferably, at least one spacer 125*c* is provided between the entrance guider body 110 and the flange 125, by which the gap size between the inner slope 116 of the screw assembling part 119 and the outer surface of the cone 126 can be adjusted.

While the spiral grooves 127*a* are formed in the outer surface of the cylinder 127 as shown in FIG. 9(*b*) and (*c*), this is not intended to limit but the spiral grooves can be extended to the outer surface of the cone 126.

A bellmouth-shaped second wire guide area 124 is provided at the front end of the central hole 122 of the entrance screw 120. Referring to the cross-section of the second wire guide area 124, the inside diameter increases gradually along the running direction of the wire W. With the second wire guide area 124 having the inside diameter enlarged beyond that of the central hole 122, at the early introduction stage of the wire W after having exiting the through hole 112, the leading end of the wire W can more easily enter the entrance guider 101 without obstruction.

At an entrance portion of the second wire guide area 124, the inside diameter (b) is preferably about 1.2 to 1.4 times of the inside diameter (a) of the central hole 122. The second wire guide area 124 is flared at an angle $\theta_1$ ranging from 60° to 90° the corn 126 is tapered at an angle $\theta_2$ ranging from 60° to 90° and the spiral grooves 127*a* are tapered at an angle $\theta_3$ ranging from 30° to 60° with respect to a horizontal axis O.

As shown in FIG. 10, the air inlet hole 118 of the entrance guider body 110 is preferably provided around an eccentric axis E spaced at a predetermined length l from a vertical axis Y, which passes the center of the central hole 122, so that the air supplied along the spiral grooves 127*a* of the cylinder 127 can form a swirl in a counterclockwise or clockwise direction into the through hole 112 of the entrance guider body 110.

While the air inlet hole 118 has been illustrated with the eccentric axis E distanced for the predetermined length l to the left from the vertical axis Y so that the air flow forced through the air inlet hole 118 revolves counterclockwise into a swirl in FIG. 10, this is not intended to limit. Rather, the eccentric position of the spiral grooves may be set contrary to the above according to the configuration of the spiral grooves 127*a* thereby to form a clockwise swirl.

In this case, the eccentricity length l of the air inlet hole 118 is necessarily formed at a size that does not exceed the radius of the inside diameter defined by the inner cylindrical surface 117.

<exit guider>

The exit guider 102 includes an exit guider body 130 and an exit screw 140 as shown in FIGS. 11 and 12(*a*) to (*c*).

The exit guider body 130 is perforated with a through hole 132 in the running direction of the wire W. The through hole 132 has an inside diameter larger than the outside diameter of the wire W to allow passage of the wire W. The exit guider body 130 has a screw assembling part 139 at the front end of the through hole 132 where the wire W exits. The screw assembling part 139 has a cross section with the inside diameter decreasing gradually along the wire running direction. The screw assembling part 139 are perforated with an air inlet hole 138 to communicate with an air supply line 103*b* for supplying high pressure compressed air.

The exit screw 140 has a central hole 142 perforated in the wire running direction. The central hole 142 is arranged coaxial with the through hole 132 of the exit guider body 130 and has an inside diameter the same as that of the through hole 132. The exit screw 140 is assembled to the rear end of the exit guider body 130 with a pre-determined gap between inner surface of the screw assembling part 139 and the outer surface of the exit screw 140 so as to leave an air path for communicating the air inlet hole 138 with the through hole 132.

The screw assembling part 139, at the front end of the exit guider body 130, is provided with an inner cylindrical surface 137 and an inner slope 136 continuously along the running direction of the wire W. The inside diameter remains at the inner cylindrical surface 137 but decreases gradually at the inner slope 136 along the running direction of the wire W. The inner cylindrical surface 137 exposes the bottom end of the air inlet hole 138.

The exit screw 140 assembled to the screw assembling part 139 described just above is provided with a cylinder 147 and a cone 146 continuously along the running direction of the wire W. The cylinder 147 has spiral grooves 147*a* formed in the outer surface opposing the inner cylindrical surface 137 with a predetermined gap, and the outer surface of the cone 146 opposes the inner slope 136 with a predetermined gap. The cylinder 147 is provided with an annular air guide groove 148 un the outer surface, corresponding to the air inlet hole 138, in which the air guide groove 148 is configured to communicate with the spiral grooves 147*a*.

With this arrangement, high pressure compression air forced through the air inlet hole 138 is introduced into the spiral grooves 147*a* via the guide groove 148. The air flowing through the spiral grooves 147*a* is supplied into the through hole 132 of the exit guider body 130 while being converted into a swirl between the inner surface of the screw assembling part 139 and the outer surface of the exit screw 140. The air flows along the running direction of the wire W passing through the central hole 142 and the through hole 132.

At the front end of the cylinder 147, a flange 145 is perforated with a plurality of fastening holes 145*a* so that the exit screw 140 can be assembled to the front end of the exit guider body 130 by means of fastening members 145*b*. Preferably, at least one spacer 145*c* is provided between the exit guider body 130 and the flange 135, by which the gap size between the inner slope 136 of the screw assembling part 139 and the outer surface of the cone 146.

While the spiral grooves 147*a* are formed in the outer surface of the cylinder 147 as shown in FIG. 12(*b*) and (*c*), this is not limiting but the spiral grooves can be extended to the outer surface of the cone 146.

A bellmouth-shaped second wire guide area 144 is provided at the front end of the central hole 142 of the exit screw 140. Referring to the cross-section of the second wire guide area 144, the inside diameter decreases gradually along the running direction of the wire W. With the second wire guide area 144 having the inside diameter larger than that of the central hole 142, at the early introduction stage of the wire W after having exited the through the through and central holes 112 and 122 of the entrance guider 101 and the sensor unit 150, the leading end of the wire W can more easily enter the exit guider 102 without obstruction.

An entrance portion of the third wire guide area 144, the inside diameter (c) is preferably about 1.2 to 1.4 times of the inside diameter (a) of the central hole 142. The third wire guide area 144 is flared at an angle $\theta_4$ ranging from 60° to 90°, the corn 146 is tapered at an angle $\theta_5$ ranging from 60° to 90°, and the spiral grooves 147*a* is tapered at an angle $\theta_6$ ranging from 30° to 60° with respect to a horizontal axis O.

As shown in FIG. 10, the air inlet hole 138 of the exit guider body 130 is preferably provided around the eccentric axis E spaced at a predetermined length l from the vertical axis Y, which passes the center of the central hole 142, so that the air supplied along the spiral grooves 147*a* of the cylinder 147 can form a swirl in a counterclockwise or clockwise direction into the through hole 112 of the exit guider body 130.

<entrance/exit sensor fixing guider>

A sensor fixing part 160 for fixing the location of the sensor unit 150 as shown in FIGS. 7 and 13(*a*) and (*b*) is provided between the inlet guide 101 and the exit guider 102. The sensor fixing part 160 includes an inlet sensor fixing guider 161 and an exit sensor fixing guider 165.

The inlet sensor fixing guider 161 is a stationary structure perforated with a through hole 162 where the wire W enters, and mounted on an entrance face of the sensor unit 150 having a predetermined size of sensor hole 152 coaxial with the through hole 162. The exit sensor fixing guider 165 is a stationary structure perforated with a through hole 162 where the wire W exits, and mounted on an exit face of the sensor unit 150.

A fourth wire guide area 163 is provided at the front end of the through hole 162 of the entrance sensor fixing guider 161. Referring to the cross section of the fourth guide area 163, the inside diameter increases gradually along the running direction of the wire W. A fifth wire guide area 167 is provided at the front end of the through hole 166 of the exit sensor fixing guider 165. In the cross section of the fifth wire guide area 167, the inside diameter decreases gradually along the running direction of the wire W.

With the fourth and fifth wire guide areas 163 and 167 having the inside diameters larger than those of the through holes 162 and 166, at the early introduction stage of the wire W, the wire W can run from the entrance guider 101 to the sensor unit 150 without obstruction.

The entrance and exit sensor fixing guiders 161 and 165 are fixed in position onto a base 190 that holds the entrance guider body 110 of the entrance guider 101 and the exit guider body 120 of the exit guider 102.

As shown in FIG. 7, the base 190 includes first and second fixing bases 191 and 192 and third and fourth fixing bases 195 and 196. First and second clamps 193 and 194 are provided to fix the entrance and exit guider bodies 110 and 120 seated on the first and second bases 191 and 192, respectively. Third and fourth clamps 197 and 198 are provided to fix the entrance and exit sensor fixing guiders 161 and 165 seated on the third and fourth bases 195 and 196, respectively.

A fixing groove 161*a* is provided in the outer surface of the entrance sensor fixing guider 161 to which the third fixing base 195 and the third clamp 197 contact and thereby generate a fixing force. Another fixing groove 165*a* is also provided in the outer surface of the exit sensor fixing guider 165 to which the fourth fixing base 196 and the fourth clamp 198 contact and thereby generate a fixing force.

In addition, assembly recesses 154 are formed in entrance and exit faces of the sensor unit 150 corresponding to the entrance and exit sensor fixing guiders 161 and 165, respectively, so that the entrance and exit sensor fixing guiders 161 and 165 can be assembled easily.

The entrance sensor fixing guider 161 assembled to the entrance face of the sensor unit 150 is preferably arranged with a predetermined gap from the rear end of the entrance guider 101 so that any vibration of the wire W introduced through the entrance guider body 110 of the entrance guider 101 can be examined with the bare eye.

The exit sensor fixing guider 165 assembled to the exit face of the sensor unit 150 is preferably arranged with a predetermined gap from the front end of the exit guider 102 so that any vibration of the wire W discharge-guided through the exit guider body 120 of the exit guider 102 can be examined with the bare eye.

While it has been described about a structure in which the entrance and exit guiders 101 and 102 are separated from the sensor unit 150 but the sensor unit 150 is fixed to the entrance and exit sensor fixing guiders 161 and 165, this is not intended to limit.

In this arrangement, the sensor unit 150 can be fixed by the entrance and exit guiders 101 and 102 which are fixed in position onto the base 190, by assembling the rear end of the entrance guider 101 to contact the entrance face where the wire W enters the sensor unit 150 or the front end of the exit guider 102 to contact the exit face where the wire W exits the sensor unit 150.

In addition, the sensor unit 150 fixed in position by the entrance and exit sensor fixing guiders 161 and 165 or the entrance and exit guiders 101 and 102 is provided as a test sensor. The test sensor has solenoid type transmitting/receiving coils to generate an eddy current on the surface of the wire passing through the sensor hole 152 by using a magnetic field produced in response to energization and thereby to detect surface defects of the wire based on any variations of the eddy current.

Alternatively, the sensor unit 150 may be provided as a Charge Coupled Device (CCD) that photographs the surface of the wire W passing through the same and thereby detects any surface defects by images.

In the meantime, the entrance guider may be provided as a roller guide that includes upper and lower rollers with the outer surface in contact with the wire W running in one direction at the entrance side of the sensor unit 150 with respect to the exit guider 102 that supplies high pressure air into the exit guider body 120 through the air supply line in a direction the same as the running direction of the wire W.

Contrary to the above, the exit guider 102 may be provided as a roller guide that includes upper and lower rollers with the outer surface in contact with the wire W running in one direction at the exit side of the sensor unit 150 with respect to the entrance guider 101 that supplies high pressure air into the entrance guider body 110 through the air supply line 103*b* in a direction counter to the running direction of the wire W.

In a process of guiding the pressed wire W in the running direction by using the pneumatic wire guide system 100, the wire W pressed in the mill rolls of the finishing mill 10 is run at a high speed of 75 m/s to 110 m/s in one direction (to the right in the drawing) by a rotational force of the mill rolls.

The wire W is run through the sensor unit 150 for detecting surface defects resulting from mill rolling and into the water cooling unit 40 for cooling the wire W. The guiding unit 100*a* has the entrance guider 101 at the entrance of the sensor unit 150 and the exit guider 102 at the exit of the sensor unit 150, and with this arrangement, provides an inner path through which the wire W runs.

In addition, the air supply units 100*b* are provided at the entrance guider 101 and the exit guider 102, respectively, to supply high pressure air. One of the air supply units 100*b* at the rear end of the entrance guider 101 supplies a swirl-like air flow counter to the running direction of the wire W into a gap between the wire W and the inner path in order to damp vibration occurring in the high speed running of the wire W, and the other one of the air supply units 100*b* at the front end of the exit guider 102 supplies an swirl-like air flow along the running direction of the wire W into a gap between the wire W and the inner path in order to damp vibration occurring in the high speed running of the wire W.

That is, in the entrance guider 101 through which the wire W passes, the air flow is formed as follows: As shown in FIGS. 7 and 14(*a*) and (*b*), when high pressure air compressed to a pressure higher than the atmospheric pressure is supplied through the air supply line 103*a* communicating with the air inlet hole 118 of the entrance guider body 110, the high pressure air flows along the air guide grooves 128 of the entrance screw 120 assembled to the screw assembling part 119 of the entrance guider body 110.

When the air introduced into the air guide grooves 128 flows through the gap between the inner cylindrical surface 117 of the screw assembling part 119 and the cylinder 127 of the entrance screw 120, the spiral grooves 127*a* of the cylinder 127 imparts spiral revolution to the air flow.

Then, the air flow having the spiral revolution is accelerated to a high speed while passing through the gap between the inner slope 116 of the screw assembling part 119 and the cone 126 of the entrance screw 120, and then ejected as swirl in a direction counter to the running direction of the wire W that enters the through hole 112 of the entrance guider body 110.

As shown in FIG. 10, the air inlet hole 118 to which the high pressure air is introduced is arranged on the eccentric axis E, which is offset from the vertical axis Y passing the center of the central hole 122 of the entrance screw 120, thereby to impart high speed revolution to the air supplied to the air guide grooves 128 in the counterclockwise direction in the drawing.

In addition, since the spiral grooves 127 are inclined for the predetermined angle $\theta_3$ of 45° with respect to the horizontal axis O, the air flowing along the spiral grooves 127*a* is ejected at a high speed along both of axial and circumferential directions, into a space between the inner slope 116 of the screw assembling part 119 and the cone 126 of the entrance screw 120. When ejected to the space between the inner slope 116 and the cone 126, the air is accelerated to a high speed in the circumferential direction while flowing in the axial direction, thereby producing a strong revolving force.

Then, as shown in FIGS. 14(*a*) and (*b*), the air swirl having a high speed revolving force with circumferential and axial thrust imparted in the space is ejected to the entrance side of the entrance guider body 110 with axial thrust directed counter to the running direction of the wire W while revolving at a high speed in a counterclockwise circumferential direction (in the drawing) along the inner periphery of the through hole 112 of the entrance guider body 110.

Here, in a process where the high pressure air is ejected to the entrance side while revolving into a high speed swirl in the through hole 112 of the entrance guider body 110, the flow rate of the air moving along the inside wall of the through hole 112 is faster than that of the air moving through a central portion of the through hole 112. Thus, as reported in Table 1 below, the air has a high pressure of the atmospheric pressure or more around the inside wall of the through hole 112 but a relatively lower pressure in the central portion of the through hole 112.

TABLE 1

| Air pressure(kg/cm$^2$) | Angle of spiral groove ($\theta_3$) (°) | Angle of air nozzle (°) | Pressure* (pha) | Pressure** (pha) |
|---|---|---|---|---|
| 2 | 30 | 30 | 1418 | 980 |
| 2.4 | 60 | 30 | 1722 | 920 |
| 3 | 45 | 30 | 2300 | 870 |

Note)
Pressure* Pressure on the wall of the through hole
Pressure Pressure in the central portion of the through hole In Table 1 above, it can be appreciated that the air pressure difference between the inside wall and the central portion of the through hole increases in proportion to the pressure of the air supplied through the air inlet hole 118. In addition, the largest air pressure difference can be obtained when the spiral grooves 127***a* for inducing the swirl-like air flow has a specific angle 45°.

In an event that an air pressure of the atmospheric pressure or more takes place in the inside wall of the through hole 112 and another air pressure of the atmospheric pressure or less takes placed in the central portion of the through hole 112, the wire W introduced into the through hole 112 is pushed toward a low pressure side, that is, the central portion of the through hole 112 under the pressure difference occurring in the through hole 112 as shown in FIG. 15(*a*).

In addition, as shown in FIG. 15(*b*), in an event that the wire W moves toward and touches the inside wall of the through hole 112 due to vibration, the high speed swirl-like air ejected counter to the wire running direction through the through hole 112 of the entrance guider body 110 forms an air film and at the same time a pressure difference takes place between the inside wall portion and the central portion of the through hole 112. This as a result can minimize the wire W contacting the inside wall of the through hole 112 while pushing the wire W toward the center of the through hole 112 as a guiding action so that the wire W can be located in the center of the through hole 112 and run in one direction.

Accordingly, the wire W accompanying with vibration during passage of the through hole 112 of the entrance guider body 110 is greatly reduced in contacts with the inside wall of the through hole 112. This as a result reduces abrasion of the through hole 112 greatly while damping the vibration of the wire W.

When the swirl-like air is ejected to the entrance side through the through hole 112 of the entrance guider body 110 to form the air film, a part of the air is ejected toward the exit through the central hole 122 of the entrance screw 120 by a resistance resulting from the running force of the wire W exiting the exit side through the through hole 112.

In addition, the air revolving at high speed and ejected to the entrance side of the through hole 112 can remove secondary scales from the wire W passing through the through hole 112, thereby protecting the sensor unit 150 from any secondary scales.

After ejected out of the through hole 112 of the entrance guider body 110, the wire W runs through the central hole 122 of the screw 120 to the entrance and exit sensor fixing guiders 161 and 165 and the sensor unit 150.

Here, like the first wire guide area 114 formed at the front end of the through hole 112 of the entrance guider body 110, the second wire guide area 124 with the inside diameter increasing gradually along the wire running direction is formed at the front end of the central hole 122 of the entrance screw 120. The fourth and fifth wire guide areas 163 and 167 with the inside diameter increasing gradually along the wire running direction are formed also in the entrance and exit sensor fixing guiders 161 and 165, respectively. With this arrangement, at the early introduction stage, the wire W enters the sensor unit 150 through the through hole 112 and the central hole 122 without obstruction so that the sensor unit 150 can detect surface conditions of the wire W by using an eddy current or by images.

After being detected of the surface conditions through the sensor hole 152 of the sensor unit 150, the wire W enters the inner path of the exit guider 102 through the exit sensor fixing guider 165 at a high speed of 75 m/s to 110 m/s.

The air flow in the exit guider 102 which the wire W passes through is also similar to that described above with reference to FIGS. 7 and 11. That is, when the compressed air having a pressure higher than the atmospheric pressure is supplied through the air supply line 103*b* communicating with the air inlet hole 138 of the exit guider body 130, the high pressure air flows along the air guide grooves 148 of the exit screw 140 assembled to the screw assembling part 139 of the exit guider body 130.

The air introduced into the air guide grooves 148 obtains a strong and high speed revolving force in the same fashion as described above. That is, the air achieves spiral circumferential and axial thrust from the spiral grooves 147*a* of the cylinder 147 while flowing through the gap between the inner cylindrical surface of the screw assembling part 139 and the cylinder 147 of the entrance screw 140.

Accordingly, the swirl-like air flow has the high speed revolving force with circumferential and axial thrust imparted during its passage through the space between the inner cylindrical surface 137 and the cylinder 147. Then, like the above-described process, the air flow revolves at a high speed circumferentially along the inner circumference of the through hole 132 of the exit guider body 130 and is ejected to the exit side of the exit guider body 130 with axial thrust along the running direction of the wire W.

In this process where the high pressure air is ejected to the entrance side while revolving into a high speed swirl in the through hole 132 of the entrance guider body 130, the flow rate of the air moving along the inside wall of the through hole 132 is faster than that of the air moving through a central portion of the through hole 132. Thus, the air has a high pressure of the atmospheric pressure or more around the inside wall of the through hole 132 but a relatively lower pressure in the central portion of the through hole 132.

Then, the wire W introduced into the through hole 132 is naturally pushed to a low pressure side or the central portion of the through hole 132 by the pressure difference in the through hole 132. When the wire W vibrates, the high speed swirl-like air ejected along the wire running direction through the through hole 132 of the exit guider body 130 forms an air film and at the same time a pressure difference takes place between the inside wall portion and the central portion of the through hole 132. This as a result can minimize the wire W contacting the inside wall of the through hole 132 while pushing the wire W toward the center of the through hole 132 as a guiding action so that the wire W can be located in the center of the through hole 132 and run in one direction.

Accordingly, the wire W accompanying with vibration during passage of the through hole 132 of the exit guider body 130 is greatly reduced in contacts with the inside wall of the through hole 132. This as a result reduces abrasion of the through hole 132 greatly while damping the vibration of the wire W.

In this case, most of the swirl-like air ejected to the exit side through the through hole 132 of the exit guider body 130 to form the air film exits rapidly toward the exit side through the through hole 132, which acts to push the wire W toward the exit thereby damping the vibration of the wire by contact resistance with the inside wall of the through hole 132 of the exit guider body 130.

After being ejected out of the exit guider 120, the wire W is cooled down to a temperature of 800° C. or less through the water cooling unit 140 and then wound into a coil C by the head corn 50. The wire coil C is then air cooled to a temperature of about 300° C. to 500° C.

EXAMPLE

In an arrangement where the sensor unit 150 for detecting surface conditions is fixedly located by the entrance and exit sensor fixing guiders 161 and 165, the entrance guider 101 composed of the entrance guider body 110 and the entrance screw 120 is fixedly located at the entrance side of the sensor unit 150, and the exit guider 102 composed of the exit guider body 130 and the exit screw 140 is fixedly located at the exit side of the sensor unit 150, a test was performed to detect surface defects of a wire W which was press-rolled according to the following conditions, by using the sensor unit 150 while guiding the wire W in one direction.

Inside diameter of the through hole 112 of the entrance guider body 110: 9 mm Inside diameter of the through hole 162 of the entrance sensor fixing guider 161: 9 mm Inside diameter of the sensor hole 152 of the sensor unit 150: 11 mm Inside diameter of the through hole 166 of the exit sensor fixing guider 165: 9 mm Inside diameter of the through hole 132 of the exit guider body 130: 9 mm Supplied air pressure: 3 kg/cm$^2$ Diameter of the wire W: 5.5 mm Running rate of wire W: 103 m/s Distance between the exit side of the entrance guider 101 and the entrance side of the exit guider 102: 150 mm In the above conditions, when high pressure air is supplied to the through hole 112 of the entrance guider body 110 and the through hole 132 of the exit guider body 130, the air revolves along the wall of the through holes 112 and 132 through which the wire W passes, producing a high speed swirl. The high speed air swirl is ejected, at the entrance guider 101, to the entrance side counter to the running direction of the wire W, but at the exit guider 102, to the exit side along the running direction of the wire W.

In this state, when the front end of the wire W having a diameter of 5.5 mm and a running rate of 103 m/s enters the through hole 112 of the entrance guider body 110, guided by the first wire guide area 114, the air swirl revolving along the wall of the through hole 112 resists against and thereby introduces the wire W toward the central portion of the through hole 112. This as a result minimizes the wire W contacting the wall of the through hole 112 when the wire W vibrates.

Then, while passing through the entrance sensor fixing guider 161, the wire W is guided to enter the exit guider 102 through the sensor unit 150 and the exit sensor fixing guider 165. The through holes 162 and 166 of the entrance and exit sensor fixing guiders 161 and 165 are configured to be smaller about 2 mm than the inside diameter of the sensor hole 152 of the sensor unit 150 to guide the front end of the wire W so that the front end of the wire W can pass through the sensor unit safely without contact.

The front end of the wire W is guided into central hole 114 of the exit screw 140 and the through hole 132 of the exit guider body 130 of the exit guider 102 through the through hole 166 of the exit sensor fixing guider 165.

High speed air swirl revolving circumferentially is ejected from the entrance side to the exit side of the exit guider 102 along the inside wall of the through hole 132 of the exit guider body 130 in a direction the same as that of the running direction of the wire W.

In this case also, the high speed air swirl revolving along the wall of the through hole 132 resists against and thereby guides the wire W toward the central portion of the through hole 132. This as a result minimizes the wire W contacting the wall of the through hole 112 when the wire W vibrates.

In a case where the sensor unit 150 is provided in an eddy current tester configured to detect surface detects using eddy current, the front end of the wire W passing through the sensor unit 150 generates an eddy current in a circuit of a test sensor, which applies a voltage to a receiving circuit of the test sensor. Then, an output value of the test sensor outputs a front end signal and a defect signal to a display unit 159 of a controller as shown in FIG. 16 so that an operator can recognize the result.

Upon having exited the exit guider 102, the wire W passes through the water cooling unit 40 and the head corn 50 in following procedures. As high speed control characteristics of the milling procedure, the thrust of mill rolls generates severe vibration to the wire between the finishing mill and the head corn 50.

Such vibration of the wire are damped in amplitude by the force of the high speed air swirl revolving along the inner walls of the through holes 11 and 132 of the entrance and exit guider bodies 110 and 130 of the entrance and exit guider 101 and 102.

This also can minimize the wire W contacting and wearing the inner path of the entrance and exit guider 101 and 102.

The vibration of the wire W is damped in latitude by the entrance and exit sensor fixing guiders 161 and 165 so that the wire W does not contact the sensor unit 150 in an inside diameter section of the sensor hole 152 of the sensor unit 150 arranged between the entrance and the exit sensor fixing guiders 161 and 165. This as a result can prevent surface defects of the wire and thus damages of the sensor unit.

In the meantime, since the revolving force of the air changes relatively according to the pressure of the air supplied into the entrance and exit guiders 101 and 102, the amount of abrasion of the entrance guider body 110 of the entrance guider 101 is measured according to the above-mentioned conditions and results are shown in FIG. 26.

As shown in FIG. 26, the inside diameter of the through hole 112 of the entrance guider body 110 through which the wire W passes wears less with the pressure of the air supplied into the through hole 112 increasing.

In addition, when a constant pressure of air is supplied into the entrance and exit guiders 101 and 102, the revolving force of the air changes according to the circumferential angle of the spiral grooves 127*a*. Thus, the amount of abrasion of the entrance guider body 110 of the entrance guider 101 is measured according to the above-mentioned conditions and results are shown in FIG. 27.

As shown in FIG. 27, the inside wall of the through hole of the entrance guider body 110 through which the wire W passes shows a minimum amount of abrasion when the spiral grooves 127*a* have an angle of 45°.

As shown in FIGS. 26 and 27, it can be appreciated that the abrasion of the entrance and exit guider bodies 110 and 130 is reduced greatly according to the pressure of the air supplied into the entrance and exit guiders 101 and 102 and the angle of the spiral grooves.

Mode for the Invention

FIG. 17 is an overall configuration view illustrating a wire guider of air guide type according to another embodiment the invention. The wire guider of air guide type 1000 of the present invention is installed between a finishing-rolling mill and a water cooling device and adapted to detect surface flaws of a rolled wire rod W having passed through the finishing-rolling mill while guiding the rolled wire rod W toward the water cooling device to alleviate vibration of the wire rod W. The wire guider of air guide type 1000 basically comprises: an entrance guider 1000*a*; an exit guider 1000*b*; an air supply unit 1000*c*; and a cooling water supply unit 1000*d*.

The entrance and exit guiders 1000*a* and 1000*b* are provided, respectively, at entrance and exit sides of a sensor unit 1000*e* that is used to detect surface flaws of the wire rod W. Each of the entrance and exit guiders 1000*a* and 1000*b* has an inner passage, which is perforated therethrough along a movement direction of the wire rod W to guide one-directional movement of the wire rod W. The inner passage of each guider has an inner diameter larger than an outer diameter of the wire rod W that is linearly moved in one direction after being discharged from the finishing-rolling mill.

The air supply unit 1000*c* serves to forcibly supply high-pressure air into the inner passages of the entrance and exit guiders 1000*a* and 1000*b*, so as to generate an air swirl between an outer surface of the wire rod W and inner surfaces of the inner passages of the entrance and exit guiders 1000*a* and 1000*b*. Here, the generated air swirl has a faster flow rate than a movement speed of the wire rod W.

With the above described configuration, it is possible to minimize or prevent the wire rod W from coming into contact with the entrance and exit guiders 1000*a* and 1000*b* within the inner guiding passages for the wire rod W. This has the effect of preventing wear and damage to the wire rod W, entrance and exit guiders 1000*a* and 1000*b*, and sensor unit 1000*e*.

<entrance guider>

The entrance guider 1000*a*, as shown in FIG. 17 to FIG. 19, is provided at the entrance side of the sensor unit 1000*e* that is used to inspect a surface state of the wire rod W being linearly moved in one direction. The entrance guider 1000*a* serves to guide the wire rod W as the wire rod W is introduced into the sensor unit 1000*e*. The entrance guider 1000*a* includes: an entrance guiding body 1110; an entrance screw member 1120; and an entrance sensor fixing guider 1130.

The entrance guiding body 1110 has a first through-bore 112, which is perforated through the body 1110 along the movement direction of the wire rod W and has an inner diameter larger than the outer diameter of the wire rod W, so as to allow the wire rod W to pass therethrough in one direction.

The entrance guiding body 1110 also has a first screw member assembling portion 119 provided at a rear end of the first through-bore 1112. Here, the rear end of the bore 1112 is a wire rod discharge end. The first screw member assembling portion 1119 has a cross section in which an inner diameter thereof gradually increases in a forward movement direction of the wire rod W. The first screw member assembling portion 1119 is perforated with an air inlet hole 1118 in a direction intersecting with the movement direction of the wire rod W. The air inlet hole 1118 is connected to the air supply unit 1000*c* having a first air supply line 1103*a* for supplying high-pressure compressed air.

The entrance sensor fixing guider 1130 has a second through-bore 1132, which is perforated through the guide 1130 along the movement direction of the wire rod W to coincide with the first through-bore 1112 and has an inner diameter larger than the outer diameter of the wire rod W, so as to allow the wire rod W to pass therethrough in one direction.

The entrance sensor fixing guider 1130 also has a second screw member assembling portion 1139 provided at a front end of the second through-bore 1132. Here, the front end of the bore 1132 is a wire rod introduction end. The second screw member assembling portion 1139 has a cross section in which an inner diameter thereof gradually decreases in the forward movement direction of the wire rod W. The second screw member assembling portion 1139 is perforated with an air inlet hole 1138 and a cooling water inlet hole 1138(*a*) in a direction intersecting with the movement direction of the wire rod W. The air inlet hole 1138 is connected to the air supply unit 1000*c* having a second air supply line 1103*b* for supplying high-pressure compressed air. The cooling water inlet hole 1138(*a*) is connected to the cooling water supply unit 1000*d* having a cooling water supply line 1104 for supplying cooling water at a high pressure.

The entrance screw member 1120 has a center bore 1122, which is perforated through the member 1120 along the movement direction of the wire rod W to coincide with the first and second through-bores 1112 and 1132 and has the same inner diameter as that of the first and second through-bores 1112 and 1132. The entrance screw member 1120 is assembled between the entrance guiding body 1110 and the entrance sensor fixing guider 1130.

The entrance screw member 1120 includes a front entrance screw member 1120*a* and a rear entrance screw member 1120*b*. The front entrance screw member 1120*a* is assembled to a rear end of the entrance guiding body 1110 in such a manner that a gap is provided between an inner surface of the first screw member assembling portion 1119 and an outer surface of the front entrance screw member 1120*a*. The gap serves as an air passage for communicating the air inlet hole 1118 with the first through-bore 1112.

The rear entrance screw member 1120*b* is assembled to a front end of the entrance sensor fixing guider 1130 in such a manner that a gap is provided between an inner surface of the second screw member assembling portion 1139 and an outer surface of the rear entrance screw member 1120*b*. The gap serves as another air passage for communicating the air inlet hole 1138 with the second through-bore 1132.

Here, the entrance guiding body 1110 has a first wire rod guiding portion 1114 formed at a front end of the first through-bore 1112. The first wire rod guiding portion 1114 has a bell-mouse shape in which an inner diameter thereof gradually increases in a direction opposite to the forward movement direction of the wire rod W. Also, the entrance screw member 1120 has a second wire rod guiding portion 1124 formed at a front end of the center bore 1122. Similarly, the second wire rod guiding portion 1124 has a bell-mouse shape in which an inner diameter thereof gradually increases in a direction opposite to the forward movement direction of the wire rod W.

Accordingly, if the wire rod W is initially introduced into the entrance guider 1000*a*, the wire rod W can be more easily introduced into the entrance sensor fixing guider 1130 through the first and second wire rod guiding portions 1114 and 1124 as expanded inner diameter portions of the first through-bore 1112 and the center bore 1132 without the risk of being caught by the bores 1112 and 1132.

The first screw member assembling portion 1119 is formed in a rear end portion of the entrance guiding body 1110 to be assembled to the front entrance screw member 1120*a*, so as to define the air passage. The first screw member assembling portion 1119 has an inner inclined surface 1116 to obtain a cross section in which the inner diameter of the portion 1119 increases in the forward movement direction of the wire rod W, and an inner circumferential surface 1117 to obtain a cross section in which the inner diameter of the portion 1119 is constant along the movement direction of the wire rod W. The inner inclined surface 1116 and inner circumferential surface 1117 are sequentially formed along the forward movement direction of the wire rod W. A lower end of the air inlet hole 1118, which is connected to the first air supply line 1103*a* for supplying high-pressure compressed air, is exposed at the inner circumferential surface 1117.

The front entrance screw member 1120*a* is assembled to the first screw member assembling portion 1119 having the above described configuration. The front entrance screw member 1120*a* has a front conical portion 1126*a* having an outer surface corresponding to the inner inclined surface 1116 by a predetermined distance therebetween, and a front cylindrical portion 1127*a* having an outer surface corresponding to the inner circumferential surface 1117 by a predetermined distance therebetween. The front conical portion 1126*a* and front cylindrical portion 1127*a* are sequentially formed along the forward movement direction of the wire rod W. The outer surface of the front cylindrical portion 1127*a* is formed with at least one spiral groove 1129*a* and an annular air guiding groove 1128(*a*). The annular air guiding groove 1128(*a*) is formed at a position corresponding to the air inlet hole 1118 and connected to the spiral groove 1129*a*.

With the above described configuration, if high-pressure compressed air is forcibly introduced through the air inlet hole 1118 connected to the first air supply line 1103*a*, the air is introduced into the spiral groove 1129*a* through the air guiding groove 1128(*a*). As a result of passing through the spiral groove 1129*a*, the air is converted into a spiral air flow between the inner surface of the first screw member assembling portion 1119 and the outer surface of the front entrance screw member 1120*a*. Thereby, the spiral air flow is supplied into the first through-bore 1112 of the entrance guiding body 1110. In this case, the spiral air flow is guided in a direction opposite to the forward movement direction of the wire rod W that passes through the first through-bore 1112.

The second screw member assembling portion 1139 is formed in a front end portion of the entrance sensor fixing guider 1130 to be assembled to the rear entrance screw member 1120*b*, so as to define the air passage. The second screw member assembling portion 1139 has an inner circumferential surface 1137 to obtain a cross section in which the inner diameter of the portion 1139 is constant in the movement direction of the wire rod W, and an inner inclined surface 1136 to obtain a cross section in which the inner diameter of the portion 1139 decreases in the forward movement direction of the wire rod W. The inner circumferential surface 1137 and inner inclined surface 1136 are sequentially formed along the forward movement direction of the wire rod W. A lower end of the air inlet hole 138, which is connected to the second air supply line 1103*b* for supplying high-pressure compressed air, is exposed at the inner circumferential surface 1137.

The rear entrance screw member 1120*b* is assembled to the second screw member assembling portion 1139 having the above described configuration. The rear entrance screw member 1120*b* has a rear cylindrical portion 1127*b* having an outer surface corresponding to the inner circumferential surface 1137 by a predetermined distance therebetween, and a rear conical portion 1126*b* having an outer surface corresponding to the inner inclined surface 1136 by a predetermined distance therebetween. The rear cylindrical portion 1127*b* and rear conical portion 1126*b* are sequentially formed along the forward movement direction of the wire rod W. The outer surface of the rear cylindrical portion 1127*b* is formed with at least one spiral groove 1129*b* and an annular air guiding groove 1128(*b*). The annular air guiding groove 1128(*b*) is formed at a position corresponding to the air inlet hole 1138 and connected to the spiral groove 1129*b*.

With the above described configuration, if high-pressure compressed air is forcibly introduced through the air inlet hole 1138 connected to the second air supply line 1103*b*, the air is introduced into the spiral groove 1129*b* through the air guiding groove 1128(*b*). As a result of passing through the spiral groove 1129*b*, the air is converted into a spiral air flow between the inner surface of the second screw member assembling portion 1139 and the outer surface of the rear entrance screw member 1120*b*. Thereby, the spiral air flow is supplied into the second through-bore 1132 of the entrance sensor fixing guider 1130. In this case, the spiral air flow is guided in the same direction as the forward movement direction of the wire rod W that passes through the second through-bore 1132.

The entrance screw member 1120 further includes a flange portion 1125 provided between the front and rear cylindrical portions 1127*a* and 1127*b* to integrally connect them with each other. Preferably, at least one spacer 1125*a* may be provided between the flange portion 1125 and the entrance guiding body 1110 and adapted to adjust the size of a gap that is defined between the inner inclined surface 1116 of the first screw assembling portion 1119 and the outer surface of the front conical portion 1126*a* of the front entrance screw member 1120*a*. Similarly, at least one spacer 1125*b* may be preferably provided between the flange portion 1125 and the entrance sensor fixing guider 1130 and adapted to adjust the size of a gap that is defined between the inner inclined surface 1136 of the second screw assembling portion 1139 and the outer surface of the rear conical portion 1126*b* of the rear entrance screw member 1120*b*.

Here, the flange portion 1125 has a plurality of first fastening holes 1125*c* to be assembled to the rear end of the entrance guiding body 1110 by use of a plurality of fastening members, and a plurality of second fastening holes 1125*d* to be assembled to the front end of the entrance sensor fixing guider 1130. The first and second fastening holes 1125*c* and 1125*d* are formed in the flange portion 1125 at different positions from each other so that the first fastening holes 1125*c* coincide with fastening holes 1111 formed in the entrance guiding body 1110 and the second fastening holes 1125*d* coincide with fastening holes 1131 formed in the entrance sensor fixing guider 1130.

Meanwhile, the entrance sensor fixing guider 1130 has the cooling water inlet hole 1138(*a*), which is perforated through the second screw member assembling portion 1139 to correspond to the air guiding groove 1128(*b*) of the rear entrance screw member 1120*b*. The cooling water inlet hole 1138(*a*) is connected to the cooling water supply line 1104 of the cooling water supply unit 1000*d*.

With the above described configuration, if cooling water is forcibly introduced through the cooling water inlet hole 1138 (*a*) connected to the cooling water supply line 1104, the cooling water is introduced into the spiral groove 1129*b* through the air guiding groove 1128(*b*), along with the air supplied through the air inlet hole 1138 of the second screw member assembling portion 1139. As a result of passing through the spiral groove 1129*b*, the mixture of the cooling water and air is converted into a spiral fluid flow between the inner surface of the second screw member assembling portion 1139 and the outer surface of the rear entrance screw member 1120*b*. Thereby, the spiral fluid flow is supplied into the second through-bore 1132 of the entrance sensor fixing guider 1130 in the same direction as the forward movement direction of the wire rod W.

It is noted that the spiral grooves 1129*a* and 1129*b* of the front and rear entrance screw members 1120*a* and 1120*b* are illustrated in FIGS. 19(*b*) and 19(*c*) as if they are formed only at the outer surfaces of the front and rear cylindrical portions 1127*a* and 1127*b*, but they are not limited thereto, and the spiral grooves 1129*a* and 1129*b* may extend over the outer surfaces of the front and rear conical portions 1126*a* and 1126*b*.

Preferably, the first through-bore 1112 of the entrance guiding body 110, the center bore 1122 of the entrance screw member 1120, and the second through-bore 1132 of the entrance sensor fixing guider 1130 have the inner diameter as large as 1.5 to 2 times that of the outer diameter of the wire rod W, to guarantee smooth one-directional movement of the wire rod W.

An entrance of the second wire rod guiding portion 1124 preferably has an inner diameter as large as 1.2 to 1.4 times that of the inner diameter of the center bore 1122. Preferably, the second wire rod guiding portion 1124 is tapered by an angle θ1 of 60° to 90°, and the front conical portion 1126*a* is tapered by an angle θ2 of 60° to 90°. Also, the spiral groove 1120*a* is preferably inclined by an angle θ3 of 30° to 60° relative to a horizontal axis.

The air inlet hole 1118 of the entrance guiding body 1110, as shown in FIG. 20, is preferably centered on an eccentric axis (e) that is spaced apart from a vertical axis (y) passing through the center of the center bore 1122 by a predetermined distance (l), to allow the air being supplied along the spiral groove 1129*a* of the cylindrical portion 1127*a* to form a clockwise or counterclockwise spiral air flow in the first through-bore 1112 of the entrance guiding body 1110.

It is noted the air inlet hole 1118 is illustrated in FIG. 20 as if the eccentric axis (e) thereof is spaced to the left side of the drawing from the vertical axis (y) by the pre-determined distance (l) so as to allow the air that is being forcibly supplied through the air inlet hole 1118 to be swirled counterclockwise, but it is not limited thereto, and the eccentric axis (e) may be spaced to the right side of the drawing from the vertical axis (y) in consideration of an extending direction of the spiral groove 1129*a*, so as to allow the air to be swirled clockwise.

Similarly, the air inlet hole 1138 and cooling water inlet hole 1138(*a*) of the second screw member assembling portion 1139 are eccentrically disposed to allow the air and cooling water supplied therethrough to take the form of a clockwise or counterclockwise air/cooling water flow.

In this case, the eccentric distance (1) of the air inlet holes 1118 and 1138 and cooling water inlet hole 1138(*a*) has to be determined within a radius range of the inner diameter defined by the inner circumferential surfaces 1117 and 1137.

<exit guider>

The exit guider 1000*b*, as shown in FIGS. 17 and 21 and FIGS. 22(*a*) to 22(*d*), is provided at the exit side of the sensor unit 1000*e* that is used to inspect a surface state of the wire rod W being linearly moved in one direction. The exit guider 1000*b* serves to guide the wire rod W as the wire rod W is discharged from the sensor unit 1000*e*. The exit guider 1000*b* includes: an exit sensor fixing guider 1140; an exit screw member 1150; and an exit guiding body 1160.

The exit sensor fixing guider 1140 is mounted at an exit surface of the sensor unit 1000*e* and has a third through-bore 1142 perforated therethrough along the movement direction of the wire rod W. The third through-bore 1142 has an inner diameter larger than the outer diameter of the wire rod W, so as to allow the wire rod W to pass therethrough.

The exit sensor fixing guider 1140 also has a third screw member assembling portion 1149 provided around a rear end portion of the third through-bore 1142. Here, the rear end of the bore 1142 is a wire rod discharge end. The third screw member assembling portion 1149 has a cross section in which an outer diameter thereof gradually decreases in the forward movement direction of the wire rod W. The third screw member assembling portion 1149 has an approximately conical shape and is centrally perforated therethrough with the third through-bore 1142.

The exit guiding body 1160 has a fourth through-bore 1162, which is perforated through the body 1160 along the movement direction of the wire rod W and has an inner diameter larger than the outer diameter of the wire rod W, so as to allow the wire rod W to pass therethrough in one direction.

The exit guiding body 1160 also has a fourth screw member assembling portion 1169 provided at a front end of the fourth through-bore 1162. Here, the front end of the bore 1162 is a wire rod introduction end. The fourth screw member assembling portion 1169 has a cross section in which an inner diameter thereof gradually increases in the forward movement direction of the wire rod W. The fourth screw member assembling portion 1169 is perforated with an air inlet hole 1168 in a direction intersecting with the movement direction of the wire rod W. The air inlet hole 1168 is connected to the air supply unit 1000*c* having a third air supply line 1103*c* for supplying high-pressure compressed air.

The exit screw member 1150 has a center bore 1152, which is perforated through the member 1150 along the movement direction of the wire rod W to coincide with the third and fourth through-bores 1142 and 1162 and has the same inner diameter as that of the third and fourth through-bores 1142 and 1162. The exit screw member 1150 is assembled between the exit sensor fixing guider 1140 and the exit guiding body 1160.

The exit screw member 1150 includes a front exit screw member 1150*a* and a rear exit screw member 1150*b*. The front exit screw member 1150*a* is assembled to a rear end of the exit sensor fixing guider 1140 in such a manner that a gap is provided between an outer surface of the third screw member assembling portion 1149 and an inner surface of the front exit screw member 1150*a*. The gap serves as an air passage for communicating the air inlet hole 1168 with the center bore 1152.

The rear exit screw member 1150*b* is assembled to a front end of the exit guiding body 1160 in such a manner that a gap is provided between an inner surface of the fourth screw member assembling portion 1169 and an outer surface of the rear exit screw member 1150*b*. The gap serves as another air passage for communicating the air inlet hole 1168 with the fourth through-bore 1162.

Here, the exit sensor fixing guider has a third wire rod guiding portion 1144 formed at a front end of the third through-bore 1142. The third wire rod guiding portion 1144 has a bell-mouse shape in which an inner diameter thereof gradually increases in a direction opposite to the forward movement direction of the wire rod W.

Accordingly, if the wire rod W is initially introduced into the exit guider 1000*b*, the wire rod W having passed through the sensor unit 1000*e* can be more easily introduced into the exit screw member 1150 and exit guiding body 1160 through the third wire rod guiding portion 1144 as an expanded inner diameter portion of the third through-bore 1142 without the risk of being caught by the third through-bore 1142.

The third screw member assembling portion 1149 is formed in a rear end portion of the exit sensor fixing guider 1140 to be assembled to the front exit screw member 1150*a*, so as to define the air passage. The third screw member assembling portion 1149 takes the form of a conical portion 1146, which has an outer diameter gradually decreasing in the forward movement direction of the wire rod W.

The front exit screw member 1150*a* is assembled to the third screw member assembling portion 1149 having the above described configuration. The front exit screw member 1150*a* has a front cylindrical portion 1157*a*, which has an inner inclined surface 1156*a* corresponding to an outer surface of the conical portion 1146 by a pre-determined distance therebetween. The inner inclined surface 1156*a* is formed at a front end of the center bore 1152 to obtain a cross section in which an inner diameter of the front cylindrical portion 1157*a* decreases in the forward movement direction of the wire rod W.

The fourth screw member assembling portion 1169 is formed in a front end portion of the exit guiding body 1160 to be assembled to the rear exit screw member 1150*b* so as to define the air passage. The fourth screw member assembling portion 1169 has an inner circumferential surface 1167 to obtain a cross section in which the inner diameter of the portion is constant in the forward movement direction of the wire rod W, and an inner inclined surface 1166 to obtain a cross section in which the inner diameter of the portion 1169 decreases in the forward movement direction of the wire rod W. The inner circumferential surface 1167 and inner inclined surface 1166 are sequentially formed along the forward movement direction of the wire rod W. A lower end of the air inlet hole 1168, which is connected to the third air supply line 1103*c* for supplying high-pressure compressed air, is exposed at the inner circumferential surface 1167.

The rear exit screw member 1150*b* is assembled to the fourth screw member assembling portion 1169 having the above described configuration. The rear exit screw member 1150*b* has a rear cylindrical portion 1157*b* having an outer surface corresponding to the inner circumferential surface 1167 by a predetermined distance therebetween, and a conical portion 1156*b* having an outer surface corresponding to the inner inclined surface 1166 by a predetermined distance therebetween. The rear cylindrical portion 1157*b* and conical portion 1156*b* are sequentially formed along the forward movement direction of the wire rod W. The outer surface of the rear cylindrical portion 1157*b* is formed with at least one spiral groove 1159*b* and an annular air guiding groove 1158 (*b*). The annular air guiding groove 1158(*b*) is formed at a position corresponding to the air inlet hole 1168 and connected to the spiral groove 1159*b*.

The exit screw member 1150 further includes a flange portion 1155 provided between the front and rear cylindrical portions 1157*a* and 1157*b* to integrally connect them with each other. Preferably, at least one spacer 1155*a* may be provided between the flange portion 1155 and the exit sensor fixing guider 1140 and adapted to adjust the size of a gap that is defined between the outer surface of the conical portion 1146 of the third screw member assembling portion 1149 and the inner inclined surface 1156*a* of the front exit screw member 1150*a*. Similarly, at least one spacer 1155*b* may be preferably provided between the flange portion 1155 and the exit guiding body 1160 and adapted to adjust the size of a gap that is defined between the inner inclined surface 1166 of the fourth screw assembling portion 1169 and the outer surface of the rear conical portion 1156*b* of the rear exit screw member 1150*b*.

The flange portion 1155 has at least one connecting hole 1155*e*, which connects the air passage, which is defined between the third screw member assembling portion 1149 and the front exit screw member 1150*a*, to the air guiding groove 1158(*b*) of the rear exit screw member 1150*b*.

The flange portion 1155 also has a plurality of first fastening holes 1155*c* to be assembled to the rear end of the exit sensor fixing guider 1140 by use of a plurality of fastening members, and a plurality of second fastening holes 1155*d* to be assembled to the front end of the exit guiding body 1160. The first and second fastening holes 1155*c* and 1155*d* are formed in the flange portion 1155 at different positions from each other so that the first fastening holes 1155*c* coincide with fastening holes 1141 formed in the exit sensor fixing guider 1140 and the second fastening holes 1155*d* coincide with fastening holes 1161 formed in the exit guiding body 1160.

With the above described configuration, if high-pressure compressed air is forcibly introduced through the air inlet hole 1168 connected to the third air supply line 1103*c*, the air is introduced into the spiral groove 1159*b* through the air guiding groove 1158(*b*) of the rear screw member 1150*b*. As a result of passing through the spiral groove 1159*b*, the air is converted into a spiral air flow between the inner surface of the fourth screw member assembling portion 1169 and the outer surface of the rear entrance screw member 1150*b*. Thereby, the spiral air slow is supplied into the fourth through-bore 1162 of the exit guiding body 1160. In this case, the spiral air flow is guided in the same direction as the forward movement direction of the wire rod W that passes through the fourth through-bore 1162.

In addition, if high-pressure compressed air is forcibly introduced through the connecting hole 1155*e* that is perforated through the flange portion 1155 to be connected to the air guiding groove 1158(*b*), the air is supplied into the center bore 1152 by way of the air passage defined between the conical portion 1146 of the third screw member assembling portion 1149 and the inner inclined surface 1156*a* of the front exit screw member 1150*a*. In this case, the air forms a spiral air flow to be guided in the same direction as the forward movement direction of the wire rod W that passes through the center bore 1152.

It is noted that the spiral groove 1159*b* of the rear exit member 1150*b* is illustrated in FIGS. 22(*b*) and 22(*c*) as if it is formed only at the outer surface of the rear cylindrical portion 1157*b*, but it is not limited thereto, and the spiral groove 1159*b* may extend over the outer surface of the conical portion 1156*b*.

Preferably, the fourth through-bore 1162 of the exit guiding body 1160, the center bore 1152 of the exit screw member 1150, and the third through-bore 1142 of the exit sensor fixing guider 1140 have an inner diameter as large as 1.5 to 2 times that of the outer diameter of the wire rod W, to guarantee smooth one-directional movement of the wire rod W.

Similar to the air inlet hole 1118 of the entrance guiding body 1110 as shown in FIG. 20, the air inlet hole 1168 of the exit guiding body 1160 is preferably centered on an eccentric axis (e) that is spaced apart from a vertical axis (y) passing through the center of the center bore 1152 by a predetermined distance (l), to allow the air being supplied along the spiral groove 1159*b* of the cylindrical portion 1157*a* to form a clockwise or counterclockwise spiral air flow in the through-bore 1162 of the exit guiding body 1160.

Meanwhile, the sensor unit 1000*e*, as shown in FIG. 23, has a sensor bore 1172 perforated through the center of a body thereof to allow the wire rod W, having passed through the entrance guider 1000*a*, to be introduced thereinto, and a detection sensor 1171 having a coil portion 1173 consisting of transmitting coils 1173*a* and receiving coils 1173*b* that are alternately arranged to surround the sensor bore 1172.

With the above described configuration, if power is applied to the detection sensor 1171, an electric field is generated by the solenoid type transmitting and receiving coils 1173*a* and 1173*b* of the coil portion 1173, so as to generate an eddy current in a surface of the wire rod W passing through the sensor bore 1172. Thereby, surface flaws of the wire rod W can be detected on the basis of a variation of the generated eddy current.

The sensor bore 1172 has a circular shape having a diameter, which is larger than the outer diameter (d) of the wire rod W passing therethrough. The diameter of the sensor bore 1172 is constant from an entrance to an exit of the bore 1172.

The coil portion 1173 internally defines a space having a predetermined volume suitable to mount the transmitting and receiving coils 1173*a* and 1173*b* in the detection sensor 1171. The transmitting and receiving coils 1173 and 1173*b* are separated from each other by a plurality of partitions 1174 provided in the coil portion 1173 so that they are alternately arranged on the basis of the movement direction of the wire rod W.

The above described detection sensor 1171, as shown in FIG. 24, is formed, at an entrance end surface thereof including an entrance end of the sensor bore 1172 and an exit end surface thereof including an exit end of the sensor bore 1172, with assembling grooves 1175, respectively, to facilitate an assembling operation of the entrance sensor fixing guider 1130 of the entrance guider 1000*a* and the exit sensor fixing guider 1140 of the exit guider 1000*b*.

If the eddy current is generated in the surface of the wire rod W passing through the sensor bore 1172 by the electric field that is generated by the solenoid type transmitting and receiving coils 1173*a* and 1173*b* when power is applied to the coils 1173*a* and 1173*b*, the variation of the generated eddy current is outputted on display unit 39 of a controller. For this, the detection sensor 1171 is connected to the display unit 39 by means of a cable 35.

Simultaneously, if power is applied to the transmitting coils 1173*a* of the detection sensor 1171 to allow an alternating current to flow through the transmitting coils 1173*a*, the transmitting coils 1173*a* generate a magnetic field, so as to generate an eddy current in the wire rod W passing through the sensor bore 1172.

The eddy current generated in the wire rod W varies by discontinuous surface flaws of the wire rod W. Therefore, if the receiving coils 1173*b* of the detection sensor 1171 recognize the variation of the eddy current, the result representing the variation of the eddy current is output on the display unit 39 of the controller that is connected to the detection sensor 1171 by means of the cable 35, so as to enable easy determination of the operator.

In the above described eddy detection manner for detecting surface flaws of the wire rod using the detection sensor 1171, an inner diameter ($D_1$) of a winding of the transmitting and receiving coils 1173*a* and 173*b*, as shown in FIG. 23, can be determined to be approximately the same as the diameter of the sensor bore 1172. Therefore, a load ratio ($d/D_1$) of the eddy current, which represents a ratio of the outer diameter (d) of the wire rod W to the inner diameter ($D_1$) of the winding of the transmitting and receiving coils 1173*a* and 1173*b* can be improved relative to a load ratio (d/D) in relation to the above described conventional configuration in that the separate cooling line 34 is provided in the detection sensor 31. As a result, the sensitivity of the detection sensor 1171 can be improved, resulting in high accuracy of detection.

Furthermore, since the flow path of cooling water used to cool the detection sensor 1171 is defined between the inner surface of the sensor bore 1172 and the outer surface of the wire rod W, the transmitting and receiving coils 1173*a* and 1173*b* included in the coil portion 1173 of the detection sensor 1171 can be designed to be closer to a wall surface defining the sensor bore 1172. This reduces a distance between the wire rod W to be detected and the transmitting and receiving coils 1102 and 1103, thereby achieving an increased load ratio of the eddy current.

Also, even if the cooling water contains impurities, the impurities can be discharged through the sensor bore 1172 along with the cooling water and have no bad effect on the flow of the cooling water, thus guaranteeing a constant flow rate of the cooling water. Therefore, the cooling water can stably maintain the cooling efficiency thereof and have no unnecessary effect on the variation of the eddy current to be recognized by the receiving coils 1173*b*, resulting in an improvement in the accuracy and reliability of detection of the wire rod.

It is noted that the sensor unit 1000*e* is described as if it has the detection sensor 1171 for detecting a surface state of the wire rod W passing through the sensor bore 1172 on the basis of the variation of the eddy current, but the present invention is not limited thereto, and a CCD may be provided to capture an image showing the surface state of the wire rod W that is guided from the entrance guider 1000*a* to the exit guider 1000*b*, so as to detect surface flaws of the wire rod W.

The entrance guider 1000*a*, which is provided at the entrance side of the sensor unit 1000*e*, may be a roller type guider having upper and lower rollers arranged to externally come into contact with the wire rod W that is introduced into the sensor unit 1000*e*. Similarly, the exit guider 1000*b*, which is provided at the exit side of the sensor unit 1000*e*, may be a roller type guider having upper and lower rollers arranged to externally come into contact with the wire rod that is discharged from the sensor unit 1000*e*.

The entrance and exit guiders 1000*a* and 1000*b* are secured to a base 1190 to be kept at fixed positions. The base 1190 is also used to secure the entrance and exit guiding bodies 1110 and 1160.

The base 1190, as shown in FIG. 17, includes first and second fixing bases 1191 and 1192 for supporting the entrance and exit guiding bodies 1110 and 1160 thereon, and first and second clamps 1193 and 1194 for fastening the bodies 1110 and 1160 to the fixing bases 1191 and 1192, respectively.

It is noted that the entrance and exit guiders 1000*a* and 1000*b* are described as if they are assembled to the sensor unit 1000*e* so that they come into contact with the entrance and exit surfaces of the sensor unit 1000*e*, respectively, but they are not limited thereto.

For example, to allow an operator to visually observe abnormal motion, i.e. vibration, of the wire rod W that is guided from the entrance guiding body 1110 of the entrance guider 1101 to be introduced thereinto, the entrance sensor fixing guider 1130, which is assembled to the entrance surface of the sensor unit 1000*e*, may be spaced apart from the rear end of the front entrance screw member 1120*a* provided in the entrance guiding body 1110 by a predetermined distance, under the assumption that the entrance screw member 1120 assembled to the rear end of the entrance guiding body 1110 is divided into the front and rear entrance screw members 1120*a* and 1120*b* about the flange portion 1125.

Similarly, to allow an operator to visually observe abnormal motion, i.e. vibration, of the wire rod W that is discharged therefrom into the exit guiding body 1160 of the exit guider 1101, the exit sensor fixing guider 1140, which is assembled to the exit surface of the sensor unit 1000*e*, may be spaced apart from the front end of the rear exit screw member 1150*b* provided in the exit guiding body 1160 by a predetermined distance, under the assumption that the exit screw member 1150 assembled to the front end of the exit guiding body 1160 is divided into the front and rear entrance screw members 1150*a* and 1150*b* about the flange portion 1155.

In this case, the entrance and exit sensor fixing guiders 1130 and 1140, which are separated from the entrance and exit guiders 1000*a* and 1000*b* and mounted at the entrance and exit surfaces of the sensor unit 1000*e*, are secured to the base 1190 by use of fixing bases and clamps. As stated above, the entrance and exit guiders 1000*a* and 1000*b* are secured to the base 1190.

The invention claimed is:

1. A wire guider of air guide type for guiding a wire which is run in a predetermined direction, comprising:

a guiding unit having an inner path extending along the running direction of the wire to guide the running of the wire, the inner path having an inside diameter larger than an outside diameter of the wire;

an air supply unit for supplying air into the inner path to form a spiral air flow having a speed faster than a running rate of the wire between an outer surface of the air and an inner surface of the inner path; and a sensor unit arranged in the guiding unit to inspect the wire, wherein the guiding unit includes an entrance guider arranged at an entrance side of the sensor unit and an exit guider arranged at an exit side of the sensor unit;

wherein the entrance guider includes an entrance guider body and an entrance screw;

wherein the entrance guider body has a through hole which the wire passes through, a screw assembling part arranged at a rear end of the through hole with an inside diameter increasing along the running direction of the wire and an air inlet hole communicating with the screw assembling part, and wherein the entrance screw has a central hole conforming to the through hole of the entrance guider by, and is assembled to a rear end of the entrance guider body to form an air path communicating the air inlet hole and the through hole between an inner surface of the screw assembling part and an outer surface of the entrance screw body.

2. The wire guider of air guide type according to claim 1, wherein the through hole has a first wire guide area formed at a front end, the first wire guide area having an inside diameter increasing gradually along the running direction of the wire.

3. The wire guider of air guide type according to claim 1, wherein the central hole has a second wire guide area formed at a front end, the second wire guide area having an inside diameter increasing gradually along the running direction of the wire.

4. The wire guider of air guide type according to claim 1, wherein the screw assembling part has an inside slope with an inside diameter increasing along the running direction of the wire and an inside cylindrical surface exposing a bottom end of the air inlet hole, the inside cylindrical surface having an inside diameter remaining constant along the running direction of the wire, and wherein the entrance screw has a core corresponding to the inside slope of the screw assembling part and a cylinder having a plurality of spiral grooves formed in an outer surface corresponding to the inside cylindrical surface of the screw assembling part and an air guide groove formed an outer surface corresponding to the air inlet hole.

5. The wire guider of air guide type according to claim 4, wherein entrance screw further has a flange at a rear end of the cylinder, the flange assembled to the rear end of the entrance guider body.

6. The wire guider of air guide type according to claim 5, wherein the entrance screw further has at least one spacer arranged between the entrance guider body and the flange to allow adjustment in gap size between the inner slope of the screw assembling part and the cone of the entrance screw.

7. The wire guider of air guide type according to claim 4, wherein the spiral grooves are extended to an outer surface of the cone.

8. The wire guider of air guide type according to claim 4, wherein the air inlet hole is located on an eccentric axis spaced at a predetermined distance from a vertical axis passing a center of the central hole.

9. The wire guider of air guide type according to claim 1, wherein the exit guider includes an exit guider body and an exit screw, wherein the exit guider body has a through hole which the wire passes through, a screw assembling part arranged at a rear end of the through hole with an inside diameter decreasing along the running direction of the wire and an air inlet hole communicating with the screw assembling part, and wherein the exit screw has a central hole conforming to the through hole of the exit guider body, and is assembled to a front end of the exit guider body so that air introduced from the air inlet hole forms an air path feeding to the through hole between an inner surface of the screw assembling part and an outer surface of the exit screw body.

10. The wire guider of air guide type according to claim 9, wherein the exit screw has a third wire guide area at a front end of the central hole, the third wire guide area having an inside diameter increasing gradually along the running direction of the wire.

11. The wire guider of air guide type according to claim 9, wherein the screw assembling part has an inner cylindrical surface and an inner slope, the inner cylindrical surface having an inner diameter remaining constant along the running direction of the wire and exposing a bottom end of the air inlet hole, the inner slope having an inside diameter decreasing along the running direction of the wire, and wherein the exit screw has a cylinder and a cone, the cylinder having a plurality of spiral grooves in an outer surface corresponding to the inner cylindrical surface of the screw assembling part and an air guide groove in an outer surface corresponding to the air inlet hole of the exit guider body, the cone corresponding to the inner slope of the screw assembling part.

12. The wire guider of air guide type according to claim 11, wherein the exit screw further has a flange at a front end of the cylinder, the flange assembled to a front end of the exit guider body.

13. The wire guider of air guide type according to claim 12, wherein the exit screw further has at least one spacer arranged between the exit guider body and the flange to allow adjustment in gap size between the inner slope of the screw assembling part and the cone of the exit screw.

14. The wire guider of air guide type according to claim 11, wherein the spiral grooves are extended to an outer surface of the exit screw.

15. The wire guider of air guide type according to claim 11, wherein the air inlet hole is located on an eccentric axis spaced at a predetermined distance from a vertical axis passing a center of the central hole.

16. The wire guider of air guide type according to claim 1, wherein the entrance guider comprises a roller type guide having upper and lower rollers contacting outer surfaces of the running wire at the entrance side of the sensor unit.

17. The wire guider of air guide type according to claim 1, wherein the exit guider comprises a roller type guide having upper and lower rollers contacting outer surfaces of the running wire at the exit side of the sensor unit.

18. A wire guider of air guide type for guiding a wire which is run in a predetermined direction, comprising:

a guiding unit having an inner path extending along the running direction of the wire to guide the running of the wire, the inner path having an inside diameter larger than an outside diameter of the wire;

an air supply unit for supplying air into the inner path to form a spiral air flow having a speed faster than a running rate of the wire between an outer surface of the air and an inner surface of the inner path;

a sensor unit arranged in the guiding unit to inspect the wire, wherein the guiding unit includes an entrance guider arranged at an entrance side of the sensor unit and an exit guider arranged at an exit side of the sensor unit; and a sensor fixing part arranged between the entrance and exit guiders to fixedly locate the sensor unit, wherein the sensor fixing part includes an entrance sensor fixing guider mounted at an entrance face of the sensor unit where the wire enters the sensor unit, the entrance sensor fixing guider having a through hole which the wire passes through, and an exit sensor fixing guider mounted at an exit face of the sensor unit where the wire exits the sensor unit, the exit sensor fixing guider having a through hole which the wire passes through.

19. The wire guider of air guide type according to claim 18, wherein the entrance sensor fixing guider has a fourth wire guide area in a front end of the through hole, the fourth wire guide area having an inside diameter increasing along the running direction of the wire.

20. The wire guider of air guide type according to claim 18, wherein the exit sensor fixing guider has a fifth wire guide area in a front end of the through hole, the fifth wire guide area having an inside diameter decreasing along the running direction of the wire.

21. The wire guider of air guide type according to claim 18, wherein the entrance and exit sensor fixing guiders are fixedly located on a base where the entrance and exit guiders are fixed.

22. The wire guider of air guide type according to claim 18, wherein the entrance sensor guide is arranged at a predetermined gap from a rear end of the entrance guider.

23. The wire guider of air guide type according to claim 18, wherein the exit sensor guide is arranged at a predetermined gap from a front end of the exit guider.

24. The wire guider of air guide type according to claim 18, wherein the entrance guider is assembled at a rear end to contact an entrance face of the sensor unit where the wire enters the sensor unit.

25. The wire guider of air guide type according to claim 18, wherein the exit guider is assembled at a front end to contact an exit face of the sensor unit where the wire exits the sensor unit.

26. The wire guider of air guide type according to claim 18, wherein the sensor unit comprises a test sensor for detecting surface defects of the wire using eddy current.

27. The wire guider of air guide type according to claim 18, wherein the sensor unit comprises a camera for detecting surface defects of the wire by images.

28. A wire guider of air guide type, the apparatus comprising a sensor unit to detect the surface flaws of the wire rod while guiding one-directional movement of the wire rod, further comprising:

an entrance guider having an inner passage perforated therethrough to have an inner diameter larger than an outer diameter of the wire rod, the entrance guider being provided at an entrance of the sensor unit;

an exit guider having an inner passage perforated therethrough to have an inner diameter larger than an outer diameter of the wire rod, the entrance guider being provided at an entrance of the sensor unit;

an air supply unit for supplying air into the inner passages of the entrance and exit guiders, so as to create a spiral air flow having a higher flow rate than a movement speed of the wire rod between an outer surface of the wire rod and inner surfaces of the inner passages perforated through the entrance and exit guiders; and a cooling water supply unit for providing cooling water between the wire rod and a sensor bore perforated in the sensor unit for the passage of the wire rod, so as to externally cool the sensor bore;

wherein the exit guider comprises:

an exit sensor fixing guider having a third through-bore perforated therethrough to allow the passage of the wire rod, the exit sensor fixing guider being mounted at an exit surface of the sensor unit;

an exit screw member having a center bore coinciding with the third through-bore; and an exit guiding body having a fourth through-bore perforated therethrough to allow the passage of the wire rod.

29. The wire guider of air guide type according to claim 28, wherein the entrance guider comprises:

an entrance guiding body having a first through-bore perforated in the center of the body to allow the passage of the wire rod;

an entrance screw member having a center bore coinciding with the first through-bore; and an entrance sensor fixing guider having a second through-bore perforated therethrough to allow the passage of the wire rod, the entrance sensor fixing guider being mounted at an entrance surface of the sensor unit.

30. The wire guider of air guide type according to claim 29, wherein the entrance guiding body comprises:

a first screw member assembling portion formed at a rear end of the first through-bore, the first screw member assembling portion having a cross section in which an inner diameter thereof increases in a forward movement direction of the wire rod; and a first air inlet hole connected to the first screw member assembling portion.

31. The wire guider of air guide type according to claim 30, wherein the first screw member assembling portion comprises:

an inner inclined surface to provide the first screw member assembling portion with a cross section in which the inner diameter of the first screw member assembling portion increases in the forward movement direction of the wire rod; and an inner circumferential surface to provide the first screw member assembling portion with a cross section in which the inner diameter of the first screw member assembling portion is constant in the forward movement direction of the wire rod, a lower end of the first air inlet hole being exposed at the inner circumferential surface.

32. The wire guider of air guide type according to claim 29, wherein the entrance sensor fixing guider comprises:

a second screw member assembling portion formed at a front end of the second through-bore, the second screw member assembling portion having a cross section in which an inner diameter thereof decreases in the forward movement direction of the wire rod; and a second air inlet hole and a cooling water inlet hole connected to the second screw member assembling portion.

33. The wire guider of air guide type according to claim 32, wherein the second screw member assembling portion comprises:

an inner circumferential surface to provide the second screw member assembling portion with a cross section in which the inner diameter of the second screw member assembling portion is constant in the forward movement direction of the wire rod, lower ends of the second air inlet hole and cooling water inlet hole being exposed at the inner circumferential surface; and an inner inclined surface to provide the second screw member assembling portion with a cross section in which the inner diameter of the second screw member assembling portion decreases in the forward movement direction of the wire rod.

34. The wire guider of air guide type according to claim 29, wherein the entrance screw member comprises:

a front entrance screw member defining an air passage with an inner surface of the first screw member assembling portion; and a rear entrance screw member defining another air passage with an inner surface of the second screw member assembling portion, whereby the entrance screw member is assembled between the entrance guiding body and the entrance sensor fixing guider.

35. The wire guider of air guide type according to claim 34, wherein the front entrance screw member comprises:

a front conical portion corresponding to an inner inclined surface of the first screw member assembling portion; and a front cylindrical portion having at least one spiral groove and an air guiding groove formed at an outer surface thereof corresponding to an inner circumferential surface of the first screw member assembling portion, the air guiding groove being formed to correspond to a first air inlet hole, and wherein the rear entrance screw member comprises:

a rear conical portion corresponding to an inner inclined surface of the rear screw member assembling portion; and a rear cylindrical portion having at least one spiral groove and an air guiding groove formed at an outer surface thereof corresponding to an inner circumferential surface of the second screw member assembling portion, the air guiding groove being formed to correspond to a second air inlet hole and cooling water inlet hole.

36. The wire guider of air guide type according to claim 35, wherein the spiral grooves of the front and rear cylindrical portions extend over outer surfaces of the front and rear conical portions, respectively.

37. The wire guider of air guide type according to claim 35, wherein each of the first and second air inlet holes and the cooling water inlet hole is positioned on an eccentric axis, which is spaced apart from a vertical axis passing through the center of the center bore by a predetermined distance.

38. The wire guider of air guide type according to claim 34, wherein the entrance screw member further comprises a flange portion to integrally connect front and rear cylindrical portions of the front and rear entrance screw members to each other.

39. The wire guider of air guide type according to claim 38, wherein the flange portion comprises a plurality of fastening holes to allow the entrance screw member to be assembled to the entrance guiding body and the entrance sensor fixing guider by use of a plurality of fastening members.

40. The wire guider of air guide type according to claim 38, wherein at least one spacer is provided between the entrance guiding body and the flange portion and adapted to regulate the size of a gap defined between an inner inclined surface of the first screw member assembling portion and a front conical portion of the front entrance screw member.

41. The wire guider of air guide type according to claim 38, wherein at least one spacer is provided between the entrance sensor fixing guider and the flange portion and adapted to regulate the size of a gap defined between an inner inclined surface of the second screw member assembling portion and a rear conical portion of the rear entrance screw member.

42. The wire guider of air guide type according to claim 29, wherein a first wire rod guiding portion is formed at a front end of the first through-bore, and has a cross section in which an inner diameter thereof gradually decreases in a forward movement direction of the wire rod.

43. The wire guider of air guide type according to claim 29, wherein a second wire rod guiding portion is formed at a front end of the center bore, and has a cross section in which an inner diameter thereof gradually decreases in a forward movement direction of the wire rod.

44. The wire guider of air guide type according to claim 28, wherein the exit sensor fixing guider comprises a third screw member assembling portion formed at a rear end of the third through-bore, the third screw member assembling portion having a cross section in which an outer diameter thereof decreases in a forward movement direction of the wire rod.

45. The wire guider of air guide type according to claim 44, wherein the third screw member assembling portion comprises a conical portion having a cross section in which an outer diameter thereof decreases in the forward movement direction of the wire rod.

46. The wire guider of air guide type according to claim 28, wherein the exit guiding body comprises:

a fourth screw member assembling portion formed at a front end of the fourth through-bore, the fourth screw member assembling portion having a cross section in which an inner diameter thereof increases in the forward movement direction of the wire rod; and a third air inlet hole connected to the fourth screw member assembling portion.

47. The wire rider of air guide type according to claim 46, wherein the fourth screw member assembling portion comprises:

an inner circumferential surface to provide the fourth screw member assembling portion with a cross section in which the inner diameter of the fourth screw member assembling portion is constant in the forward movement direction of the wire rod, a lower end of the third air inlet hole being exposed at the inner circumferential surface; and an inner inclined surface to provide the fourth screw member assembling portion with a cross section in which the inner diameter of the fourth screw member assembling portion decreases in the forward movement direction of the wire rod.

48. The wire guider of air guide type according to claim 46, wherein the third air inlet hole is positioned on an eccentric axis, which is spaced apart from a vertical axis passing through the center of the center bore by a predetermined distance.

49. The wire guider of air guide type according to claim 28, wherein the exit screw member comprises:

a front exit screw member defining an air passage with an outer surface of the third screw member assembling portion; and a rear exit screw member defining another air passage with an inner surface of the fourth screw member assembling portion, whereby the exit screw member is assembled between the exit sensor fixing guider and the exit guiding body.

50. The wire guider of air guide type according to claim 49, wherein the front exit screw member comprises a front cylindrical portion having an inner inclined surface formed in a front end region of the center bore to correspond to a conical portion of the third screw member assembling portion, and wherein the rear exit screw member comprises:

a rear conical portion configured to correspond to an inner circumferential surface of the fourth screw member assembling portion; and a rear cylindrical portion having at least one spiral groove and air guiding groove formed at an outer surface thereof corresponding to an inner circumferential surface of the fourth screw member assembling portion, the air guiding groove being formed to correspond to a third air inlet hole of the exit guiding body.

51. The wire guider or air guide type according to claim 49, wherein the exit screw member further comprises a flange portion to integrally connect front and rear cylindrical portions of the front and rear exit screw members to each other.

52. The wire guider of air guide type according to claim 51, wherein the flange portion comprises a plurality of fastening holes to allow the exit screw member to be assembled to the exit guiding body and the exit sensor fixing guider by use of a plurality of fastening members.

53. The wire guider of air guide type according to claim 50, wherein the spiral groove extends over an outer surface of the rear conical portion.

54. The wire guider of air guide type according to claim 51, wherein the flange portion comprises at least one connecting hole to connect an air passage between the third screw member assembling portion and the exit front screw member to an air guiding groove.

55. The wire guider of air guide type according to claim 51, wherein at least one spacer is provided between the exit sensor fixing body and the flange portion and adapted to regulate the size of a gap defined between an outer inclined surface of the third screw member assembling portion and the center bore of a front cylindrical portion of the front exit screw member.

56. The wire guider of air guide type according to claim 51, wherein at least one spacer is provided between the exit guiding body and the flange portion and adapted to regulate the size of a gap defined between a rear conical portion and an inner inclined surface of the fourth screw member assembling portion.

57. The wire guider of air guide type according to claim 28, wherein a third wire rod guiding portion is formed at a front end of the third through-bore, and has a cross section in which an inner diameter thereof gradually decreases in a forward movement direction of the wire rod.

58. The wire guider of air guide type according to claim 28, wherein the sensor unit comprises a detection sensor to detect the surface flaws of the wire rod based on a variation of an eddy current.

59. The wire guider of air guide type according to claim 58, wherein the detection sensor comprises a plurality of transmitting and receiving coils, which are alternately arranged to surround the sensor bore perforated therethrough for the passage of the wire rod.

60. The wire guider of air guide type according to claim 28, wherein the sensor unit is an image camera for detecting the surface flaws of the wire rod by capturing images of the surface flaws.

61. The wire guider of air guide type according to claim 28, wherein the entrance guider is a roller type guider comprising upper and lower rollers, which are arranged to come into external contact with the wire rod being moved in one direction at the entrance of the sensor unit.

62. The wire guider of air guide type according to claim 28, wherein the exit guider is a roller type guider comprising upper and lower rollers, which are arranged to come into external contact with the wire rod being moved in one direction at the exit of the sensor unit.

* * * * *

UNITED STATES PATENT AND TRADEMARK OFFICE

CERTIFICATE OF CORRECTION

PATENT NO. : 8,269,831 B2
APPLICATION NO. : 12/094680
DATED : September 18, 2012
INVENTOR(S) : Won-Bong Kim et al.

It is certified that error appears in the above-identified patent and that said Letters Patent is hereby corrected as shown below:

Column 39, Line 13, Claim 47, delete “rider” and insert -- guider --

Column 40, Line 1, Claim 51, delete “or” and insert -- of --

Signed and Sealed this
Eighteenth Day of December, 2012

David J. Kappos

David J. Kappos
*Director of the United States Patent and Trademark Office*